US008777361B2

(12) United States Patent
Tamagawa

(10) Patent No.: US 8,777,361 B2
(45) Date of Patent: Jul. 15, 2014

(54) LIQUID EJECTION VOLUME CONTROL APPARATUS AND METHOD, PROGRAM AND INKJET APPARATUS

(75) Inventor: Kiyomi Tamagawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 62 days.

(21) Appl. No.: 13/553,854

(22) Filed: Jul. 20, 2012

(65) Prior Publication Data

US 2013/0021400 A1 Jan. 24, 2013

(30) Foreign Application Priority Data

Jul. 22, 2011 (JP) ..... 2011-161235

(51) Int. Cl.
*B41J 2/205* (2006.01)

(52) U.S. Cl.
USPC ..... 347/15; 347/9; 347/14; 347/19

(58) Field of Classification Search
CPC ..... B41J 2/205
See application file for complete search history.

(56) References Cited

U.S. PATENT DOCUMENTS 6,390,583 B1 * 5/2002 Kato et al. ..... 347/15
6,783,203 B2 * 8/2004 Fujimori ..... 347/15
7,255,417 B2 * 8/2007 Yamazaki et al. ..... 347/19
2004/0017415 A1 * 1/2004 Nunokawa ..... 347/15
2005/0185005 A1 8/2005 Yamazaki et al.
2007/0046706 A1 * 3/2007 Kayahara et al. ..... 347/14
2008/0186348 A1 * 8/2008 Yanai et al. ..... 347/15
2008/0192267 A1 * 8/2008 Watanabe ..... 358/1.8
2009/0244154 A1 * 10/2009 Miyamoto ..... 347/15

FOREIGN PATENT DOCUMENTS

JP 2005-205711 A 8/2005
JP 2009-234115 A 10/2009

* cited by examiner

*Primary Examiner* — Manish S Shah
*Assistant Examiner* — Jeremy Delozier
(74) *Attorney, Agent, or Firm* — Birch, Stewart, Kolasch & Birch, LLP

(57) ABSTRACT

An apparatus includes: a first lookup table storage device which stores a first lookup table; a second lookup table storage device which stores a second lookup table; a halftone table storage device which stores a halftone table; a third lookup table generating device which generates a third lookup table by extracting a portion of the data from the second lookup table; a third lookup table storage device which stores the third lookup table; an evaluation processing device which performs calculation for evaluating a liquid ejection volume, on the basis of the evaluation input signal, the first lookup table, the third lookup table, the halftone table and the liquid volume per dot; and an adjusting device which adjusts the ejection volume on the basis of the evaluation results, in such a manner that the liquid ejection volume does not exceed a specified value.

19 Claims, 16 Drawing Sheets

TONE CONVERSION LUT

LIQUID EJECTION VOLUME CONTROL APPARATUS AND METHOD, PROGRAM AND INKJET APPARATUS

BACKGROUND OF THE INVENTION

1. Field of the Invention

The present invention relates to a liquid ejection volume control apparatus and method, a program and an inkjet apparatus, and more particularly, to control technology for adjusting a liquid ejection volume in a liquid ejection head having a plurality of liquid ejection ports (nozzles) to an appropriate volume.

2. Description of the Related Art

In an inkjet printing apparatus which forms an image on a recording medium by ejecting ink from a plurality of nozzles, density non-uniformities (density irregularities) are liable to occur in a recorded image due to variation in the ejection characteristics of respective nozzles of the recording head (inkjet head). As a device for correcting these density non-uniformities, a density correction value is determined for each nozzle from the ejection characteristics of each nozzle, and ejection of inks from the respective nozzles is controlled by correcting the image signal in accordance with the correction values (Japanese Patent Application Publication Nos. 2005-205711 and 2009-234115).

For example, in order to ascertain the ejection characteristics of each nozzle in the nozzle row of a recording head, a test chart for density measurement is formed on a recording medium and the optical density of the test chart is measured. Output density correction values are calculated for each nozzle position on the basis of these measurement results, and the input image signal is corrected on the basis of the calculated correction values.

In the case of an inkjet printing apparatus which includes a plurality of recording heads corresponding to each of a plurality of ink colors (for example, cyan, magenta, yellow, black), a correction lookup table (LUT) which specifies a conversion coefficient between an input signal value and an output signal value is required for each nozzle of a plurality of heads, and therefore the data volume of this group of LUTs is enormous. In particular, in the case of a recording head based on a single-pass method which can record over the full width range of the image forming region of the recording medium by one relative movement, the number of nozzles in each head is large, and therefore the data volume of the correction LUT is of the order of 100 MB.

In actual image recording (printing), it is necessary to adjust the ink volume to an appropriate ink volume for each type of paper, and therefore an operation of adjusting the ink ejection volume is carried out before printing. In this case, if the ink ejection volume is calculated by accessing the correction LUT of each nozzle, then there is a problem in that the calculation time becomes long.

A problem of this kind is not limited to an inkjet printing apparatus, and is common to systems which form various types of patterns using a liquid ejection head based on an inkjet method (for example, a wiring image formation apparatus, a fine structure forming apparatus, or the like).

SUMMARY OF THE INVENTION

The present invention was devised in view of these circumstances, an object thereof being to provide a liquid ejection volume control apparatus and method, a program and an inkjet apparatus capable of adjusting a liquid ejection volume of a liquid ejection head to an appropriate ejection volume, while shortening the processing time for calculating the liquid ejection volume.

In order to achieve the aforementioned object, the liquid ejection volume control apparatus relating to the present invention includes: a first lookup table storage device which stores a first lookup table that specifies an input/output relationship for converting tones of an input signal; a second lookup table storage device which stores a second lookup table that specifies a signal conversion relationship for correcting variation in an ejection volume in nozzle units in a liquid ejection head having a plurality of nozzles; a halftone table storage device which stores a halftone table that specifies a relationship between a dot recording rate and a signal value in a dot arrangement obtained by halftone processing; a third lookup table generating device which generates a third lookup table which is used in calculation for evaluating a liquid ejection volume, by extracting a portion of the data from the second lookup table which is prescribed in nozzle units; a third lookup table storage device which stores the third lookup table; an evaluation processing device which performs the calculation for evaluating the liquid ejection volume, the evaluation processing device for performing calculation for evaluating a liquid ejection volume corresponding to an evaluation input signal for evaluating the liquid ejection volume produced by the liquid ejection head, on the basis of the evaluation input signal, the first lookup table, the third lookup table, the halftone table and the liquid volume per dot; and an adjusting device which adjusts the ejection volume on the basis of the evaluation results from the evaluation processing device, in such a manner that the liquid ejection volume corresponding to the evaluation input signal does not exceed a specified value.

Further modes of the present invention will become apparent from the description of the present specification and the drawings.

According to the present invention, it is possible rapidly to grasp an overview of the distribution of the liquid ejection volume in a nozzle row of a liquid ejection head, and it is possible to judge whether or not to adjust the ejection volume from evaluation value calculation results. Accordingly, it is possible to make adjustment so as to achieve an appropriate ejection volume.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

<Example of Composition of Inkjet Printing System>

Figure 1:
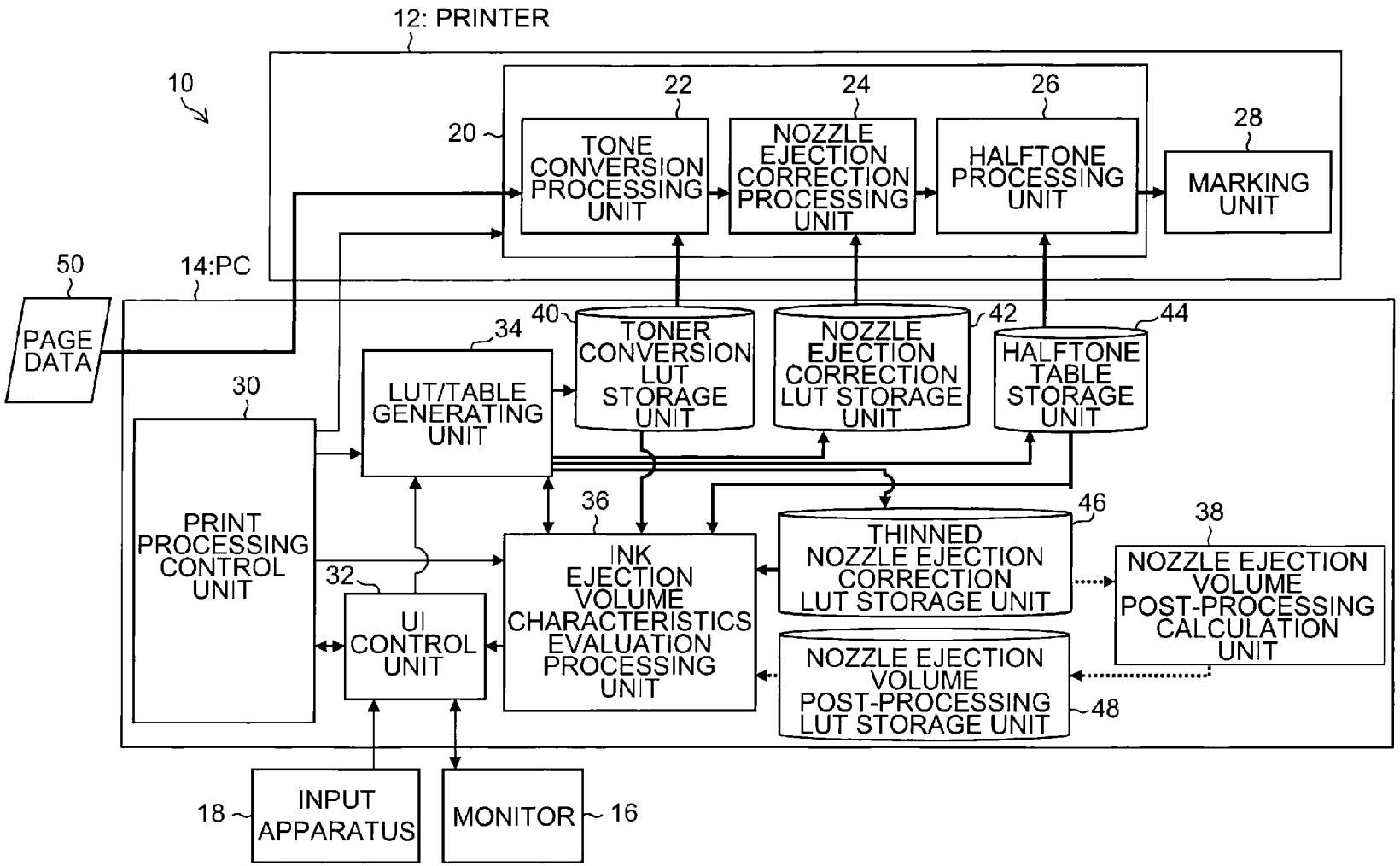
FIG. 1 is a block diagram of an example of the composition of an inkjet printing system relating to an embodiment of the present invention.

FIG. 1 is a block diagram showing an example of the composition of an inkjet printing system relating to an embodiment of the present invention. The inkjet printing system 10 is constituted by a printer 12, a computer main body (hereinafter, called "PC") 14, a monitor 16 and an input apparatus 18.

The PC 14 is connected to the printer 12. The PC 14 functions as a control apparatus which controls operations of the printer 12, and also functions as a data management apparatus which manages data of various types. As described in more detail below, the PC 14 includes various control units (30, 32, 34) which are required for controlling the printer 12, signal processing units (36, 38) and data storage units (40, 42, 44, 46, 48).

The monitor 16 and the input apparatus 18 which form a user interface (UI) are connected to the PC 14. The input apparatus 18 can employ a device of various types, such as a keyboard, a mouse, a touch panel, a tracking ball, and the like, or may use a suitable combination of these. An operator uses the monitor 16 and the input apparatus 18 to perform operations of the printer 12. When a print instruction is issued by the PC 14, page data 50 is sent to the printer 12 and is processed by an image processing circuit (image processing board) 20.

The printer 12 includes an image processing circuit 20 which carries out signal processing for converting page data 50 for printing which is input via the PC 14, into a marking signal, and a marking unit 28 which executes printing in accordance with the marking signal.

The marking unit 28 is constituted by an inkjet head, which serves as a liquid ejection head. In the present embodiment, a case is described in which inks of four colors, cyan (C), magenta (M), yellow (Y) and black (K) are used, and inkjet heads are provided for each respective color, as devices for ejecting the inks of the respective colors. However, the combination of ink colors and the number of colors is not limited to the present embodiment.

The inkjet printing system 10 according to the present embodiment is a system which records an image by a single-pass method. More specifically, the inkjet printing system 10 is able to record an image of a prescribed recording resolution (for example, 1200 dpi) on an image forming region of the recording medium, simply by performing one operation (one sub-scanning operation) of relatively moving the recording medium with respect to inkjet heads of the respective colors. A plurality of ink ejection nozzles are arranged through a length corresponding to the maximum width of the image forming region of the paper, on an ink ejection surface (nozzle surface) of each head. A high recording resolution can be achieved by a composition in which a plurality of nozzles are arranged in a two-dimensional configuration on the ink ejection surface.

In the case of an inkjet head having a two-dimensional nozzle arrangement, a projected nozzle row in which the nozzles in the two-dimensional nozzle arrangement are projected (by orthogonal projection) to an alignment in a direction (corresponding to a "main scanning direction") which is perpendicular to the medium conveyance direction (corresponding to a "sub-scanning direction") can be regarded as equivalent to a single nozzle row in which the nozzles are arranged at roughly even spacing at a nozzle density which achieves the recording resolution in the main scanning direction (the medium width direction). Here, "roughly even spacing" means substantially even spacing between the droplet ejection points which can be recorded by the inkjet printing system. For example, the concept of "even spacing" also includes cases where there is slight variation in the intervals, to take account of manufacturing errors or movement of the droplets on the medium due to landing interference. Taking account of the projected nozzle row (also called the "effective nozzle row"), it is possible to associate the nozzle positions (nozzle numbers) in the alignment sequence of the projected nozzles which are aligned following the main scanning direction. In the description given below, reference to "nozzle positions" means the positions of the nozzles in the effective nozzle rows.

The image processing circuit 20 includes a tone conversion processing unit 22, a nozzle ejection correction processing unit 24, and a halftone processing unit 26. While carrying out various processes to generate a marking signal from the input page data 50, the image processing circuit 20 carries out tone conversion processing, nozzle ejection correction processing and halftone processing to generate a marking signal.

The tone conversion processing unit 22 carries out processing for determining the characteristics of the density tones, such as what density of color to use in image formation, when forming an image with the marking unit 28. The tone conversion processing unit 22 converts the page data 50 in such a manner that the coloring characteristics specified by the printer 12 are achieved. For example, the tone conversion processing unit 22 converts the CMYK signal to a C'M'Y'K' signal in accordance with a tone conversion LUT, and converts each of the C signal, M signal, Y signal and K signal, color by color, to a C' signal, M' signal, Y' signal and K' signal.

Signal conversion by the tone conversion processing unit 22 involves determining a conversion relationship by referring to a lookup table (corresponding to a "first LUT", called "tone conversion LUT" below) which is stored in a tone conversion LUT storage unit 40 in the PC 14. A plurality of LUTs which are optimized for each type of paper (recording medium) used for printing are stored in the tone conversion LUT storage unit 40, and a suitable LUT is referred to in accordance with the type of paper used. Tone conversion LUTs of this kind are prepared for each color of ink. In the case of the present embodiment, tone conversion LUTs are provided respectively for each color of C, M, Y and K.

When a print execution instruction is input, the tone conversion LUT matching the corresponding print conditions is selected automatically and is set in the tone conversion processing unit 22 of the printer 12. Furthermore, by inputting instructions for selecting, modifying and correcting a LUT, and so on, via the input apparatus 18, it is possible to set up a desired LUT.

The nozzle ejection correction processing unit 24 is a processing unit which corrects the output density (ink ejection volume) of each nozzle, in such a manner that the density specified by the tone conversion processing unit 22 is a uniform density over the whole surface of the recording medium, when ink ejection has been carried out on the basis of an input signal having a certain constant tone value from each of the nozzles of the inkjet head which constitute the marking unit 28. The inkjet head has variation in ejection characteristics depending on the nozzle, and the ejected droplet volume is not necessarily uniform. Signal conversion is carried out by the nozzle ejection correction processing unit 24 in order to correct output density non-uniformities caused by this kind of variation in the ejection characteristics of the respective nozzles, in units of one nozzle.

More specifically, the nozzle ejection correction processing unit 24 converts an image signal for correcting the ejection volume of each nozzle, in such a manner that the ink ejection volume of the plurality of ink ejection nozzles in the inkjet head which constitute the marking unit 28 come within a prescribed tolerable range, both within each head and between heads, so as to eliminate color non-uniformities in the plane of the image.

For example, the nozzle ejection correction processing unit 24 converts the CMYK signal to a C"M"Y"K" signal, and converts each of the C' signal, M' signal, Y' signal and K' signal, color by color, to a C" signal, M" signal, Y" signal and K" signal. This conversion processing involves determining a conversion relationship by referring to a LUT (corresponding to a "second LUT", called "nozzle ejection correction LUT" below) which is stored in a nozzle ejection correction LUT storage unit 42 in the PC 14. A plurality of LUTs which are optimized for each type of paper (paper type) used for printing are stored in the nozzle ejection correction LUT storage unit 42, and a suitable LUT is referred to in accordance with the type of paper used.

The halftone processing unit 26 converts the image signal having multiple tones (for example, 256 tones based on 8 bits per color), in pixel units, into a binary signal which indicates ink ejection or no ink ejection, or into a multiple-value signal indicating what type of droplet to eject, if a plurality of ink diameters (droplet sizes) can be selected. In general, processing is carried out to convert multiple-tone image data having M values (where M is an integer no less than 3) into data having N values (where N is an integer no less than 2 and less than M). The halftone processing may employ a dithering method, error diffusion method, density pattern method, or the like.

The marking unit 28 according to the present embodiment can selectively eject three types of droplet sizes: a large droplet, a medium droplet and a small droplet. In this case, the halftone processing unit 26 converts the multiple-tone data (for example, 256 tones) after nozzle ejection correction processing into a signal of four values, namely: "eject large-droplet ink", "eject medium-droplet ink", "eject small-droplet ink" and "do not eject ink". The signal conversion in the halftone processing unit 26 determines the conversion relationship by referring to a table (halftone table) which is stored in a halftone table storage unit 44 in the PC 14.

The halftone table is a table which specifies the ratio in which the dots of the respective sizes (large/medium/small) are used per unit surface area, a dot ratio of the respective dot sizes being specified in accordance with the magnitude of the input signal. The halftone table storage unit 44 stores halftone tables of a plurality of types, and one of the tables is selected when printing.

The multiple-value signal generated by the halftone processing unit 26 (in the present embodiment, a four-value marking signal) is sent to the marking unit 28 and is used to control driving of ejection energy generating elements (for example, piezoelectric elements or heating elements) of the corresponding nozzles. More specifically, ink ejection from the respective nozzles in the marking unit 28 is controlled in accordance with this four-value signal. A large dot is recorded on the recording medium by large-droplet ink, a medium dot is recorded on the recording medium by medium-droplet ink, and a small dot is recorded on the recording medium by small-droplet ink. In this way, multiple tones are reproduced by surface area tones based on the arrangement of ink dots which are formed on the recording medium.

The PC 14 includes a print processing control unit 30, a user interface (UI) control unit 32, a LUT/table generating unit 34, an ink ejection volume characteristics evaluation processing unit 36, a tone conversion LUT storage unit 40, a nozzle ejection correction LUT storage unit 42, a halftone table storage unit 44 and a thinned nozzle ejection correction LUT storage unit 46. Furthermore, the PC 14 may also include a nozzle ejection volume post-processing calculation unit 38 and a nozzle ejection volume post-processing LUT storage unit 48, according to requirements. These respective units (32 to 48) are constituted by hardware or software of the PC 14, or by a combination of these.

The print processing control unit 30 controls the operation of the printer 12. The print processing control unit 30 controls processing of various kinds in the LUT/table generating unit 34 and the ink ejection volume characteristics evaluation processing unit 36, and the like, as well as controlling the display of the monitor 16 and implementing control in accordance with input instructions from the input apparatus 18, in association with the UI control unit 32.

The LUT/table generating unit 34 generates data, such as a tone conversion LUT, nozzle ejection correction LUT, halftone table, thinned nozzle ejection correction LUT, and the like, in accordance with control signals from the print processing control unit 30 and instruction signals (operating signals) supplied from the UI control unit 32.

The ink ejection volume characteristics evaluation processing unit 36 calculates an ink volume to be ejected by the marking unit 28 in respect of a prescribed evaluation input signal, on the basis of the tone conversion LUT, the thinned nozzle ejection correction LUT and the halftone table, and evaluates whether or not print quality is affected thereby. In other words, for each evaluation item that affects print quality, and for each head of the respective colors, an ink volume condition which affects print quality is determined, and it is judged whether or not the ink volume exceeds a critical specified value which affects print quality. If the ink volume exceeds the specified value, then this judgment result is displayed on the monitor 16 via the UI control unit 32. In conjunction with this display of the evaluation result, an instruction input from the input apparatus 18 is accepted, an operation for changing (amending) the tone conversion LUT, nozzle ejection correction LUT, halftone table, and the like is prompted, and the density is adjusted in such a manner that the output density (ink volume) comes within the specified value.

<Description of Conversion Processing by Image Processing Circuit 20>

Here, a concrete example of processing by the image processing circuit 20 in the printer 12 is described with reference to FIG. 2 to FIG. 5.

Figure 2:
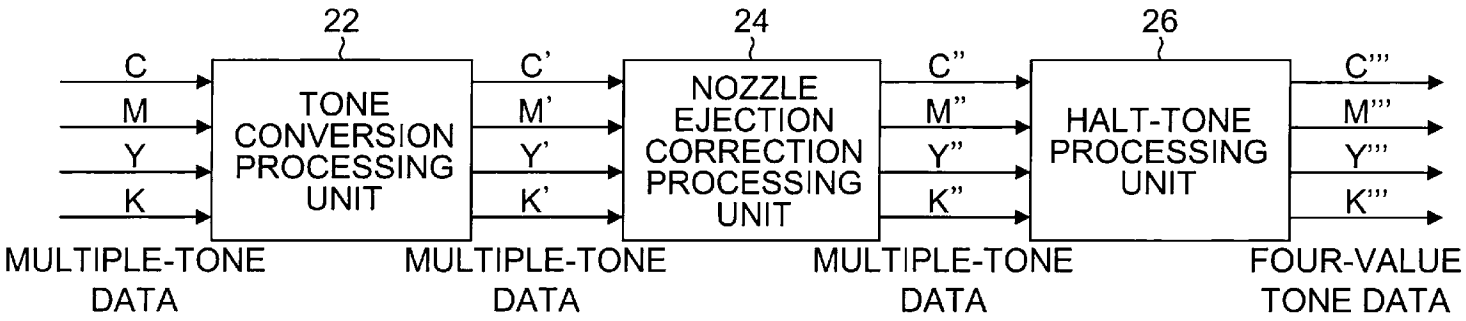
FIG. 2 is an illustrative diagram showing processing of an image processing circuit.

FIG. 2 is an illustrative diagram showing a processing sequence of the image processing circuit 20. Multiple-tone data divided into the respective colors of C, M, Y, K is input to the tone conversion processing unit 22. Here, it is supposed that multiple-tone image data for each ink color in the marking unit 28 is supplied (for example, 256-tone image data for each color corresponding to the four colors of CMYK).

Commonly known color conversion processing and resolution conversion processing is carried out if 24-bit RGB full-color image data (8 bits per color) is input, or if there is a difference between the resolution of the input image and the output resolution of the inkjet image forming apparatus.

The tone conversion processing unit 22 employs a table (tone conversion LUT) for each color of C, M, Y and K, and converts the input signal to a certain target density tone. The CMYK signal which is input to the tone conversion processing unit 22 is converted to a C'M'Y'K' signal by the tone conversion LUTs for each color.

Figure 3:
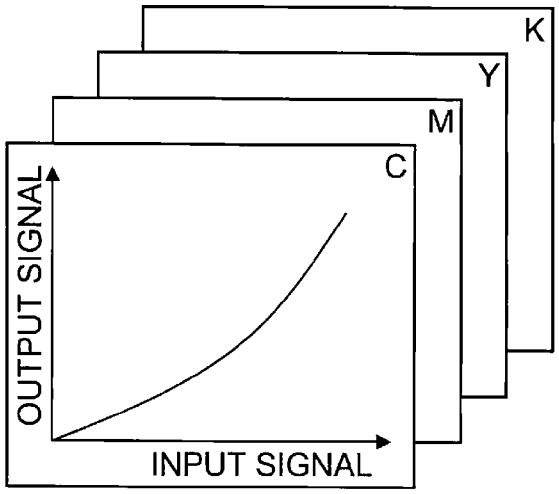
FIG. 3 is an illustrative diagram of the a tone conversion LUT used in a tone conversion processing unit.

FIG. 3 is a conceptual diagram of a tone conversion LUT used in the tone conversion processing unit 22. As shown in FIG. 3, tone conversion LUTs are provided respectively for each signal of the colors C, M, Y, K, and each specifies an input/output relationship for converting an input signal value to an output signal value. The signal which has been converted in accordance with the tone conversion LUT is input to the nozzle ejection correction processing unit 24 (see FIG. 2).

Figure 4:
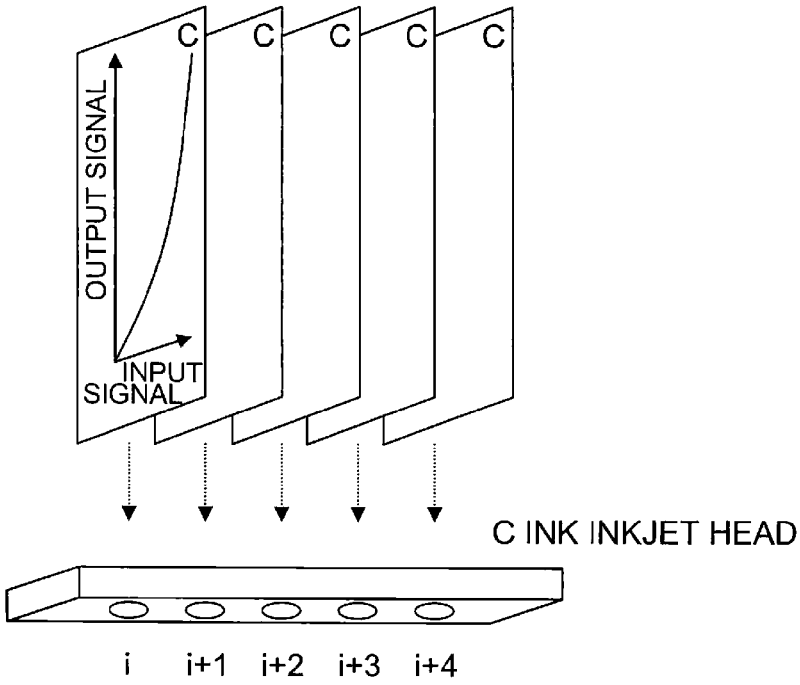
FIG. 4 is an illustrative diagram of correction processing in a nozzle ejection correction processing unit.

FIG. 4 is a conceptual diagram of correction processing in the nozzle ejection correction processing unit 24 (see FIG. 1 and FIG. 2). In FIG. 4, a reduced number of nozzles is depicted in the C ink inkjet head, but actually there are respective ejection correction LUTs corresponding to each of the nozzles provided in each color head. The values i, i+1, . . . , i+4 in FIG. 4 represent the nozzle numbers. As shown in FIG. 4, for each nozzle, there is a LUT which specifies the conversion relationship between the input signal value and the output signal value for that nozzle, and a LUT group is formed by collecting these tables for all of the nozzles. A similar LUT group exists for each of the respective color heads.

The nozzle ejection correction processing unit 24 (FIG. 1, FIG. 2) converts the input C'M'Y'K' data to C"M"Y"K" data, using the nozzle ejection correction LUT. In FIG. 1 and FIG. 2, for the sake of the description, an example is shown in which the tone conversion processing and the nozzle ejection correction processing are carried out in stepwise fashion, but it is also possible to adopt a calculation method in which the tone conversion LUT and the nozzle ejection correction LUT are synthesized and collected into one LUT, and these conversion processes are carried out simultaneously. The converted signal generated by the tone conversion processing and the nozzle ejection correction processing is input to the halftone processing unit 26 (see FIG. 2).

Figure 5:
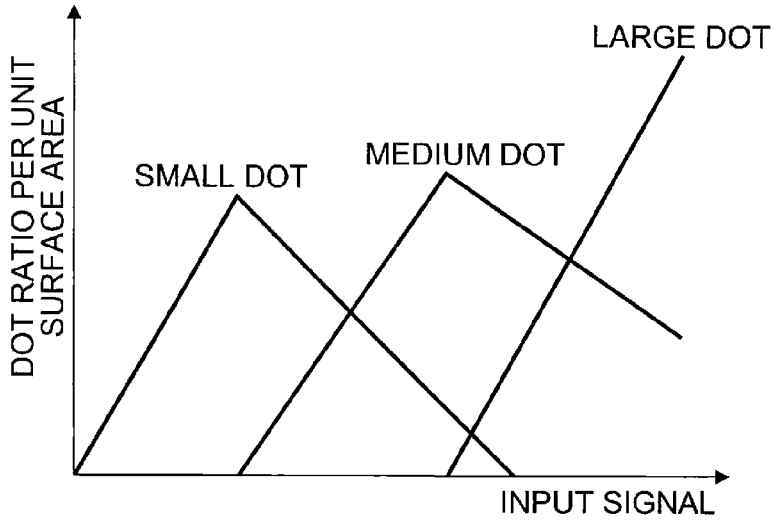
FIG. 5 is a diagram showing one example of a halftone table employed in a halftone processing unit.

FIG. 5 shows one example of a halftone table which is employed in the halftone processing unit 26 (see FIG. 1, FIG. 2). The horizontal axis in FIG. 5 represents an input signal and the vertical axis is an amount indicating the recording ratio (dot ratio) of large, medium and small ink dots per unit surface area. For example, the vertical axis in FIG. 5 is an amount which indicates a ratio of the respective numbers of large, medium and small-dot inks which are ejected in a region where ink droplets can be ejected in a maximum of 100 pixels (corresponding to the "unit surface area"). A plurality of halftone tables specifying the ratio in which the respective types of dots are to be used are prepared for the input signal values, and one of these tables is selected when printing.

<Description of Method of Generating Nozzle Ejection Correction LUT>

Figure 6:
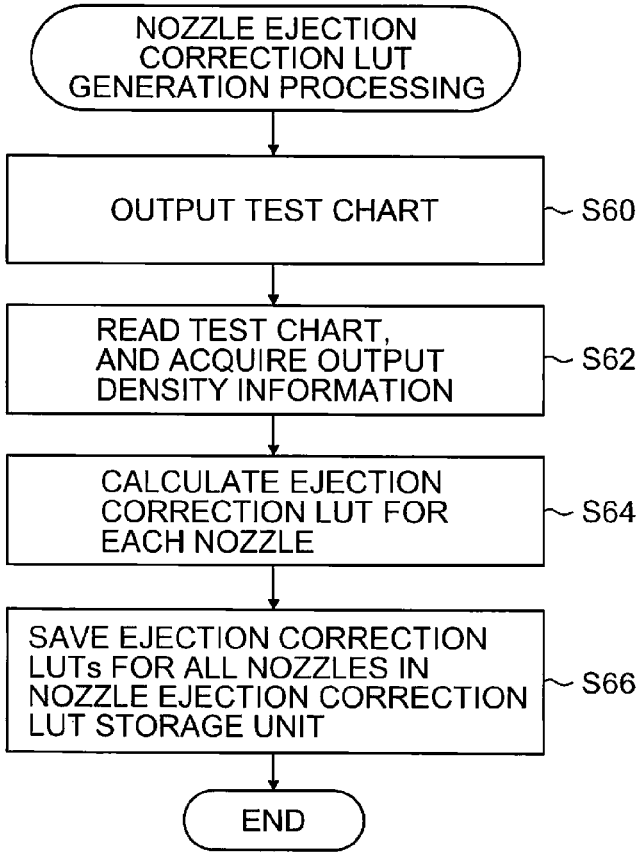
FIG. 6 is a flowchart showing one example of a procedure for generating a nozzle ejection correction LUT.

The nozzle ejection correction LUTs applied in the nozzle ejection correction processing unit 24 (FIG. 1, FIG. 2) are generated by a procedure such as the following. FIG. 6 is a flowchart showing one example of a procedure for generating a nozzle ejection correction LUT. The timing of the calculation for creating the nozzle ejection correction LUT may be any timing and is not limited in particular. For example, it is possible to adopt a mode in which a test chart is output and correction values are calculated before carrying out a printing job, a mode in which a test chart is output and correction values are calculated once, each time a prescribed number of prints have been made, a mode in which a test chart is output and correction values are calculated before printing, when the paper type or paper size is switched, a mode in which a test chart is output in a margin of a recording medium and correction values are calculated, each time an image is output, or a mode in which correction values are calculated as described above during periodic maintenance, or when there is an instruction from a user. The data of the nozzle ejection correction LUT is updated at an appropriate timing.

When the nozzle ejection correction LUT generating process shown in FIG. 6 is started, firstly, a test chart used for measuring the recorded density distribution is output (step S60).

Figure 7:
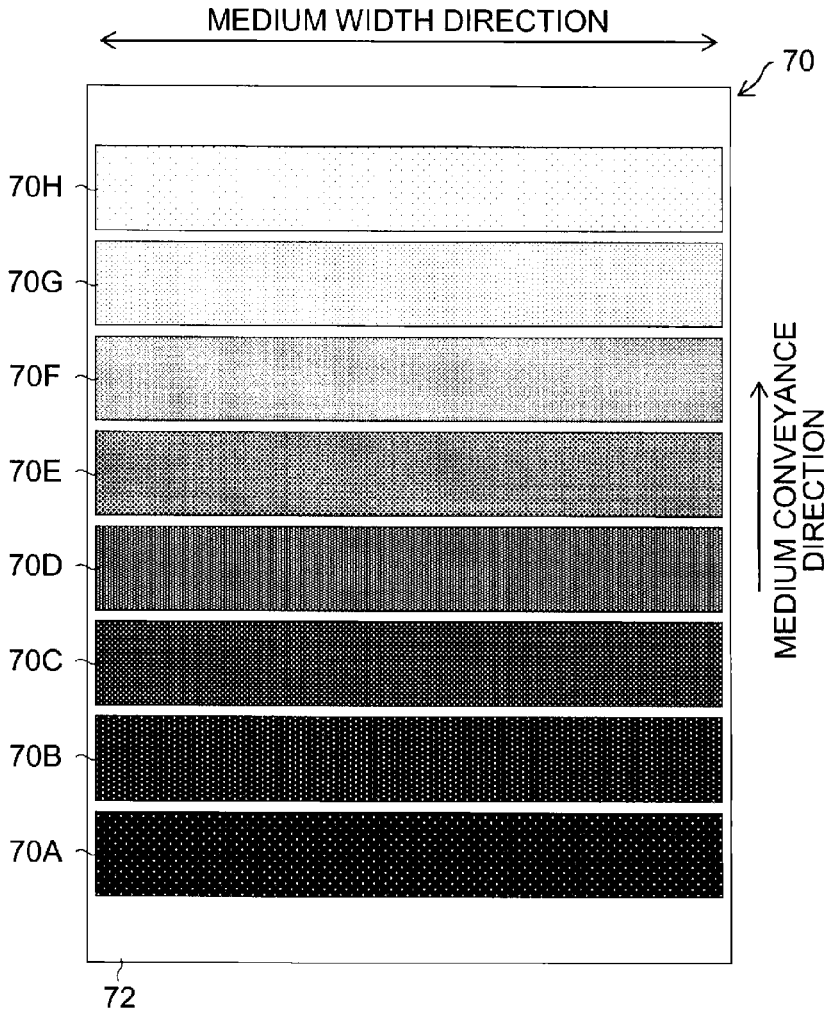
FIG. 7 is a diagram showing one example of a test chart for density measurement.

FIG. 7 is a diagram showing one example of a test chart which is recorded on a recording medium. The test chart 70 for density distribution measurement shown in FIG. 7 is constituted by a plurality of band-shaped patterns 70A to 70H (here, eight patterns) which have different tone values. The band-shaped patterns 70A to 70H have a long rectangular shape in the medium width direction which is perpendicular to the medium conveyance direction. The medium width direction is the direction of the effective nozzle row in the line head, and the band-shaped patterns 70A to 70H are formed to a roughly uniform density in a range corresponding to the length of the nozzle row. Here, "roughly uniform density" means constant in terms of the tone instruction value (set value) when recording the pattern. By measuring the density distribution of the pattern formed on the basis of a constant tone value instruction, it is possible to ascertain the variation of the ejection characteristics of the respective nozzles corresponding to this tone value.

In the present embodiment, an example is given in which patterns 70A to 70H having different densities are formed in sequence of decreasing ink density from the upstream side toward the downstream side in the medium conveyance direction (from top to bottom in FIG. 7), but the arrangement sequence of the patterns and the number of band-shaped patterns (the number of steps in which the density is changed) are not limited in particular. The set tone values which record the respective band-shaped patterns can be set as appropriate and the number of band-shaped patterns can be designed as appropriate. A test chart 70 of this kind is formed for each respective color by the C, MY and K heads. Furthermore, the test chart is not limited to a mode where all of the patterns 70A to 70H are recorded on one recording medium 72, and it is also possible to record these band-shaped patterns over a plurality of sheets of recording media.

The test chart 70 formed on the recording medium 72 in this way is read in by a reading apparatus, such as an off-line scanner, or an image reading sensor (in-line sensor) which is provided in the paper conveyance path of the inkjet printing system 10, and read data (electronic image data) for the test chart 70 is thereby acquired. An optical density (OD) value is determined at each position in the image, from this read data, and output density data indicating the output recording density (ink density) corresponding to each position is acquired (step S62 in FIG. 6). A characteristics curve indicating the ejection characteristics (recording density characteristics) of each nozzle is acquired on the basis of the output density data determined in this way, and the input tone values.

Figure 8:
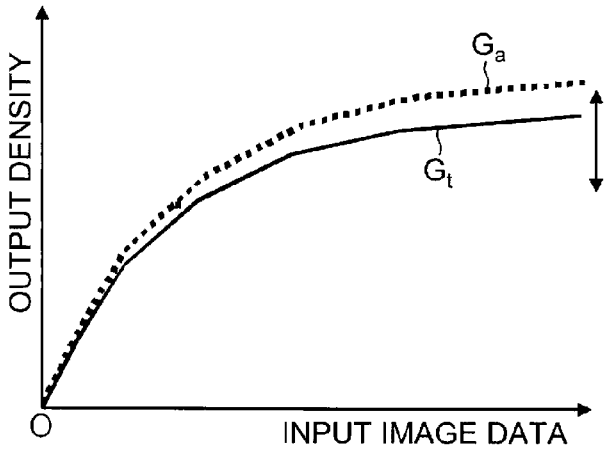
FIG. 8 is a graph showing an example of an ejection characteristics curve for a certain nozzle.

FIG. 8 is a graph showing an example of an ejection characteristics curve for a certain nozzle. The horizontal axis represents input image data (input tone value) and the vertical axis represents the output density. The curve Gt in FIG. 8 shows a characteristics curve of a nozzle as acquired from the test chart read results. The curve Ga shown by the dotted line in FIG. 8 represents a characteristics curve (appropriate characteristics curve) obtained when appropriate ink ejection is carried out in line with design expectations. As shown in FIG. 8, the actual characteristics curve Gt of the nozzle usually deviates to some extent from the appropriate characteristics curve, due to manufacturing variations and other factors, and hence variations in the output density values between nozzles are observed, as shown by the up and down arrows in FIG. 8. The characteristics curves Gt of the nozzles are compared with the appropriate characteristics curve Ga and a table of correction values for controlling ejection of the corresponding nozzles (an ejection correction LUT) is generated in accordance with the results of this comparison (step S64 in FIG. 6).

In this way, an ejection correction LUT is determined for all of the nozzles, and these ejection correction LUTs for all of the nozzles are stored in the nozzle ejection correction LUT storage unit 42 (see FIG. 1) (step S66 in FIG. 6). By a comparison of the nozzle characteristics curve Gt and the appropriate characteristics curve Ga, it is possible to judge whether or not the nozzle is an ejection failure nozzle, or an ejection abnormality nozzle which is of a level that cannot be corrected. Furthermore, it is also possible to form a test pattern including a so-called 1-on n-off type of line pattern, and to ascertain ejection failure nozzles, ejection volume abnormalities, depositing position error, and the like, from the read results.

An ejection failure nozzle or an ejection abnormality nozzle which cannot be corrected is taken to be a defective nozzle which cannot be used for recording, and is handled so as not to be driven to eject during image recording. Ejection correction LUTs for the defective nozzles which have been disabled for ejection in this way do not have to be stored in the nozzle ejection correction LUT storage unit 42.

<Overview of Method for Calculating Correction Values Corresponding to Ejection Control of Each Nozzle>

FIGS. 9A to 9D are illustrative diagrams showing one example of processing for determining a correction LUT for each nozzle. As shown in S200 in FIG. 9A, table data for a resolution conversion curve indicating correspondences between the pixel positions of the reading apparatus (density measurement positions) and the nozzle positions is previously stored in a memory, and from the read results of the test chart, each measurement density position (for example, pixel positions at a reading resolution of 400 dpi) in the read data (scan image) of the test chart is converted to a position of the corresponding nozzle in the inkjet head (for example, nozzle positions in a nozzle row which achieves a recording resolution of 1200 dpi), in accordance with the resolution conversion curve.

Figure 9A:
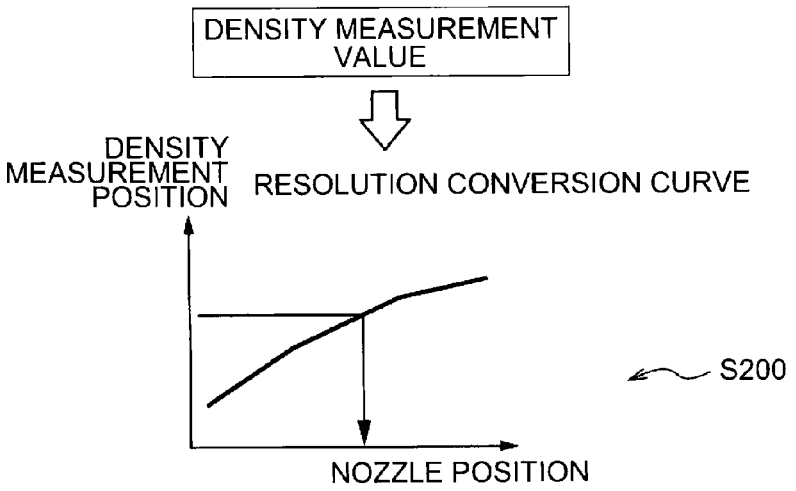
FIGS. 9A to 9D are illustrative diagrams showing one example of processing for determining an ejection correction LUT for each nozzle.
Figure 9B:
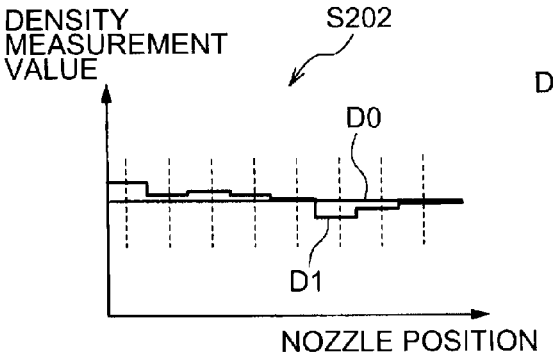

The nozzle positions determined in this way and the density measurement values (output density values) D1 in the test chart corresponding to the nozzle positions are associated as shown in S202 in FIG. 9B, and the difference between the previously determined and stored target density value D0 and the density measurement value (output density value) D1 is calculated. The target density value D0 used here is a target value for the ink density ejected from the corresponding nozzle, and can be determined appropriately according to requirements. For example, it is also possible to calculate an average density of the ink ejected from a predetermined nozzle range and to store this average density as a target density value D0.

Figure 9C:
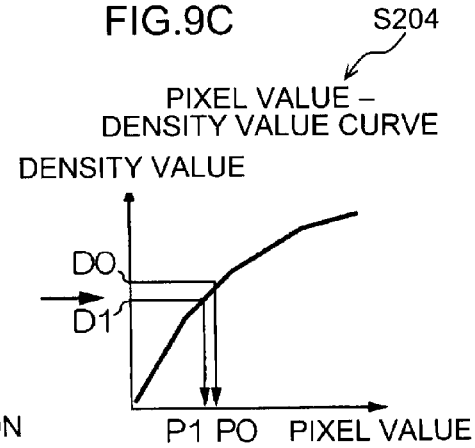
Figure 9D:
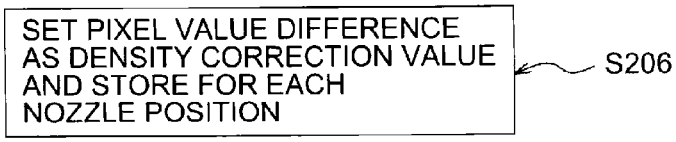

As shown in S204 in FIG. 9C, the output pixel values (the "pixel values" in S204) P0, P1 which correspond to the density measurement value (output density value) D1 and the target density value D0 (the "density value" in S204) are determined in accordance with a pixel value/density value curve which indicates a correspondence relationship between the pixel value and the density value that is determined previously by experimentation. The difference (P0-P1) between the output pixel values is stored as a density correction value for each nozzle position (S206 in FIG. 9D).

In this way, a correction value corresponding to the input signal value (pixel value) is determined for each nozzle, and an nozzle ejection correction LUT which specifies the relationship between the output signal and the input signal is obtained for each nozzle. The procedure for generating the nozzle ejection correction LUT described above is no more than an illustrative example, and it is also possible to create a nozzle ejection correction LUT by another procedure.

<Overview of Signal Processing in PC 14>

The signal processing for evaluation of the ink ejection volume characteristics which is installed in the PC 14 will be described next. The PC 14 has a function for evaluating the ink ejection volume produced by the marking section 28, on the basis of the data in the tone conversion LUTs, the nozzle ejection correction LUTs and the halftone tables, and judging whether or not that ink volume is of a level which affects print quality.

In calculating an evaluation value in the ink ejection volume characteristics evaluation processing unit 36 (see FIG. 1), ink ejection volume calculation pre-processing is carried out in advance and a special LUT is generated for use in calculation processing to evaluate the ink ejection volume characteristics. The special LUT which is generated by this pre-processing is a separate LUT (corresponding to a "third LUT") which is generated from the nozzle ejection correction LUT that is used by the nozzle ejection correction processing unit 24. The reason for carrying out "ink ejection volume calculation pre-processing" in this way is in order to shorten the calculation time for evaluation of the ink ejection volume characteristics.

The nozzle ejection correction LUT is a group of table data from the LUTs of individual nozzles, and has a large data volume and takes time for file access. Consequently, there is a problem in that if the nozzle ejection correction LUT is used directly for the ink ejection volume characteristics evaluation processing, then the calculation time becomes long.

To give a concrete example, a case is now examined where a long line head is used, the line head being based on a single pass method (a single-pass page-wide head) and being capable of recording onto the whole image formation range in the long edge direction of paper of half Kiku size (636 mm×469 mm) in one paper conveyance action. In the case of a system having a recording resolution of 1200 dpi, in which inkjet heads of respective colors corresponding to the four colors of C, M, Y, K are aligned in the paper conveyance direction, there are approximately 30,000 nozzles in each head. This is the number of nozzles for each ink color (in the present embodiment there are four colors), and therefore the total number of nozzles is approximately 120,000.

If the ink ejection volume of each nozzle in a four color head group is controlled by using LUTs, then tens of thousands of 12-bit input and 12-bit output LUTs corresponding to the total number of nozzles are handled. The data size of nozzle ejection correction LUTs of this kind is extremely large (for example, around 200 MB), and data access is bound to take time of order of minutes.

In order to resolve this problem, in the present embodiment, only the data required for calculation by the ink ejection volume characteristics evaluation processing unit 36 is extracted from the nozzle ejection correction LUT so as to create a separate LUT, thereby reducing the size of the LUT which needs to be referenced for evaluation calculations. A LUT which is created by extracting necessary data from the nozzle ejection correction LUT in this way is called a "thinned nozzle ejection correction LUT".

It is possible to employ the following methods, for example, to generate a LUT (thinned nozzle ejection correction LUT) for use in calculation for evaluating the ink ejection volume by extracting a portion of the data from the nozzle ejection correction LUT.

(1) A thinned nozzle ejection correction LUT is generated by extracting data from the nozzle ejection correction LUT at constant nozzle spacing or uneven nozzle spacing, in the alignment sequence of the nozzles.

(2) A thinned nozzle ejection correction LUT is generated by extracting data for nozzles in a region where the ejection volume is relatively large, from the nozzle ejection correction LUT. The device for judging the region where the ejection volume is relatively large can adopt various types of methods, such as a method which compares an average value of the ejection volume, a method which examines deviation of the data, and a method which extracts a constant number of data in order from the largest ejection volume, or a method which judges the density of distribution of the data in order from the largest ejection volume, or the like.

(3) A thinned nozzle ejection correction LUT is generated by extracting data for nozzles in a region where the ejection volume exceeds a reference value, from the nozzle ejection correction LUT.

(4) It is also possible to generate a nozzle ejection correction LUT by further extracting a portion of the data from the nozzle data extracted by the methods in (1) to (3) described above.

(5) Furthermore, it is also possible to suitably combine the methods in (1) to (4) described above.

In the case of the present embodiment, particular attention is paid to a region where the ink use volume (ejection volume) is large, on the basis of the nozzle ejection correction LUT, and the state of the ink ejection volume is evaluated by using only data at suitable nozzle spacing, in this region. If the ink use volume is large, the paper becomes undulated, and indentations are liable to occur in three-dimensions. Due to this indented deformation of the paper, there are cases where the conveyance of the paper is obstructed, for instance, where the paper becomes caught during conveyance. From the viewpoint of preventing this, it is desirable to restrict the ink volume within a certain specific volume. The inkjet printing system 10 according to the present embodiment calculates and evaluates the ink ejection volume from the tone conversion LUT, the thinned nozzle ejection correction LUT (or the nozzle ejection volume post-processing LUT described below), and the halftone table, or the like, and uses this ink ejection volume in density adjustment to specify an upper limit for the ink volume. The actual specific value of the ink volume (the upper value of the tolerable range) which is a condition for preventing indentations and wrinkles in the paper depends on the type of paper and the physical values of the ink used, and the like, and therefore experimentation, and the like, is carried out in advance to determine the specific value (threshold value).

In the calculation for evaluating the ink ejection volume in the present embodiment, if only the signal for a region of large ink use volume is determined from data at appropriate nozzle spacing (even spacing or uneven spacing), then it is possible to roughly identify the state of the ink ejection volume, and therefore all of the data of the nozzle ejection correction LUT is not necessarily required. If there is an output density distribution in the effective nozzle alignment direction of the nozzle row in which a plurality of nozzles are arranged (the main scanning direction in the case of the present embodiment), then a particular problem is that the ink volume exceeds the specific volume. Consequently, even if the ink volume is not investigated in detail for all of the nozzles which constitute the nozzle row, it is sufficient to investigate the portion of the nozzle row where the ink use volume is large, discretely, at a suitable spacing.

Furthermore, in order to ascertain the output density distribution of the whole nozzle row, it is sufficient to evaluate the ink ejection volume at a suitable nozzle spacing (a constant nozzle spacing or an uneven nozzle spacing) in the nozzle alignment sequence (the nozzle number sequence in the actual nozzle row). A nozzle number i can be assigned to each nozzle as a consecutive integer, i=1, 2, 3, . . . , from the end of the effective nozzle row which is capable of forming a dot row at the recording resolution, and the position of a nozzle can be identified by the nozzle number.

In the present embodiment, by creating a thinned nozzle ejection correction LUT by suitably thinning the nozzles in the nozzle alignment direction, from a region having a relatively large ink use volume, and previously extracting LUTs relating to nozzles having a large ejection volume, then in the actual evaluation calculation, it is judged whether or not the ink volume exceeds the specific value, by using data for only the extracted portion.

The "region having a large ink use volume" referred to here is a region where there is a large number of nozzles having a large ink ejection volume (nozzles which eject a large ink volume in response to an instruction based on the same tone signal) in a certain unit surface area, in the two-dimensional nozzle arrangement of the inkjet head. In this region, it is possible to extract LUTs at an even nozzle spacing, or to extract LUTs at an uneven nozzle spacing.

In the present embodiment, a separate LUT ("thinned nozzle ejection correction LUT") is created in which only the minimum necessary data required for ink ejection volume characteristics evaluation processing is extracted, and this thinned nozzle ejection correction LUT is stored in the thinned nozzle ejection correction LUT storage unit 46. The calculation time for ink volume evaluation is shortened by using this thinned nozzle ejection correction LUT for calculations in the ink ejection volume characteristics evaluation processing.

In other words, the processing for generating the thinned nozzle ejection correction LUT can be carried out separately and independently without requiring coordination with the evaluation processing calculation by the ink ejection volume characteristics evaluation processing unit 36. For example, it is also possible to generate a thinned nozzle ejection correction LUT when generating the ink ejection correction LUT which is set in the printer 12. The processing for previously creating a thinned ink ejection correction LUT in this way is called "ink ejection volume calculation pre-processing".

Figure 10:
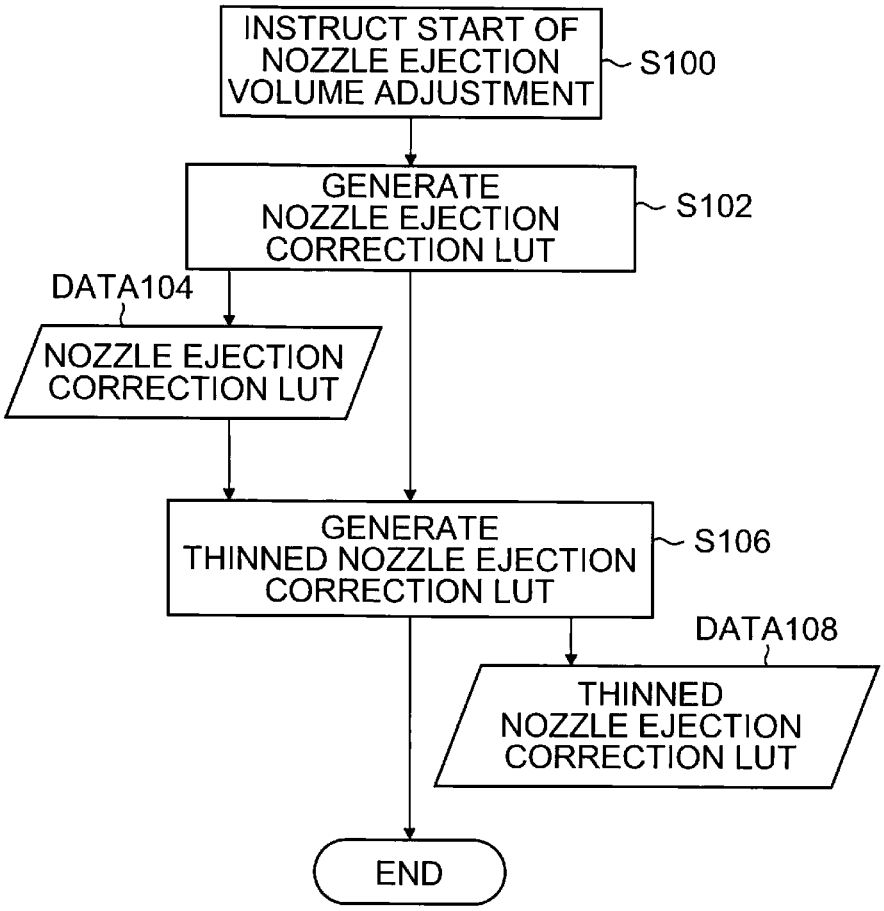
FIG. 10 is a flowchart of respective pixel processing (quantization processing)

FIG. 10 is a flowchart of the ink ejection volume calculation pre-processing. The processing flow shown in FIG. 10 is started by inputting a start instruction for nozzle ejection volume adjustment (step S100). The start instruction for nozzle ejection volume adjustment is supplied at a suitable timing, for instance, before starting executing of a printing job, when changing the paper type, or the like. This instruction signal may be generated automatically in accordance with the printing control program, or may be input from an input apparatus 18 by the operator, as necessary.

When the processing flow in FIG. 10 is started, firstly, processing for generating a nozzle ejection correction LUT is carried out (step S102). One example of processing for generating this nozzle ejection correction LUT is as described in relation to FIG. 6, FIG. 8 and FIG. 9. The print results of the test pattern for density measurement are read in, density information is acquired, the output density characteristics data for each nozzle is acquired, and a nozzle ejection correction LUT is obtained by calculating a correction value for each nozzle on the basis of this data.

The data, DATA 104, of the nozzle ejection correction LUTs for all nozzles which is generated by the processing step in step S102 in FIG. 10 is stored in the nozzle ejection correction LUT storage unit 42 in the PC 14 and is also set in the nozzle ejection correction processing unit 24 in the image processing circuit 20 of the printer 12 (see FIG. 1). Furthermore, processing for generating a thinned nozzle ejection correction LUT is carried out on the basis of this nozzle ejection correction LUT data (DATA 104) (step S106 in FIG. 10).

For example, a thinned nozzle ejection correction LUT (DATA 108) is generated by selecting a range of nozzles where the ink volume is larger than a specific volume, from the ejection correction LUTs of all of the nozzles, and extracting LUTs at a suitable nozzle spacing within this range.

In the thinned nozzle ejection correction LUT (DATA 108), it is sufficient to extract only data required for calculation in the ink ejection volume characteristics evaluation processing unit, and therefore the input values of the LUT do not have to be evenly spaced and may be unevenly spaced. For example, it is not necessary to provide all 256 points as input values in respect of an 8-bit input signal, and points may be omitted at a suitable spacing. The data points can be made "sparse" (broadening the thinning spacing between the input values) in highlight regions where not much ink is used, and the data points can be made "dense" (narrowing the spacing between the input values) in shadow regions where a large amount of ink is used.

Furthermore, the nozzle spacing does not have to be even spacing and may also be uneven spacing. For example, it is possible to create a table in which the nozzle spacing is narrow ("dense") in nozzle regions where there is a large number of nozzles having a large ink use volume, and the nozzle spacing is broad ("sparse") in regions where there is not such a large number of such nozzles.

The selection of which data to leave gives preference to leaving portions where the ink volume appears to be large. In order to identify portions where the ink volume appears to be large, from amongst the group of table data of the nozzle ejection correction LUTs which gather ejection correction LUTs for each nozzle, attention is paid to the gradient of the graph of the ejection correction LUT for each nozzle.

In the correction LUT for each nozzle, ideally, the relationship between the input value (horizontal axis: x) and the output value (vertical axis: y) is linear (y=x), having a proportional coefficient=1, but this relationship is not necessarily linear, due to variations in the ejection characteristics of the individual nozzles.

The greater the gradient (rate of change) of the curve which indicates the input/output characteristics of the correction LUT, the larger the correction amount shown. If the correction amount is large, then this means that correction for making the signal larger is applied to the input value, and the ink use volume of the nozzle is large. Consequently, it is possible to extract nozzles having a large ejection volume by looking in particular at the gradients of the respective curves, from the correction LUTs of the nozzles, and extracting the LUTs of curves having a gradient larger than a certain gradient value forming a judgment reference. The gradient of the non-linear curve may be an average gradient of all sections or prescribed sections of the curve.

A thinned nozzle ejection correction LUT is generated by further thinning out data from the nozzles extracted in this way, at even nozzle spacing or uneven nozzle spacing.

From the viewpoint of further reducing the data volume compared to the thinned nozzle ejection correction LUT, it is desirable to adopt a mode such as the following. More specifically, it is possible to advance calculation further from the thinned nozzle ejection correction LUT (DATA 104) and to carry out a portion of the calculation for evaluating the ink ejection characteristics previously, saving this data as a file in the form of intermediate data of the evaluation calculation. For example, the number of LUTs may be reduced by a method of synthesizing the ejection volume information for nozzles in a prescribed width, from the thinned nozzle ejection correction LUT (DATA 104) extracted at a suitable nozzle spacing, and collecting this information into one LUT which represents a range of this prescribed width. Furthermore, it is also possible to perform a portion of the evaluation calculation by the ink ejection volume characteristics evaluation processing unit 36, in advance, in the nozzle ejection volume post-processing calculation unit 38 (see FIG. 1), and to create a file of these results and store the file in the nozzle ejection volume post-processing LUT storage unit 48.

In this way, it is possible to adopt a mode which includes a nozzle ejection volume post-processing calculation unit 38 (see FIG. 1) which is a calculation processing unit that further reduces the number of LUTs from the thinned nozzle ejection correction LUT (DATA 104) and generates a LUT converted into the form of intermediate data of the evaluation calculation, and a nozzle ejection volume post-processing LUT storage unit 48 for storing a LUT (called a "nozzle ejection volume post-processing LUT") generated by this post-processing calculation.

In this case, the nozzle ejection volume post-processing LUT is handled as input data by the ink ejection volume characteristics evaluation processing unit 36, rather than the thinned nozzle ejection correction LUT. By this means, since the file is of a smaller data volume that the thinned ink ejection correction LUT, it is possible to shorten the calculation time yet further.

Figure 11:
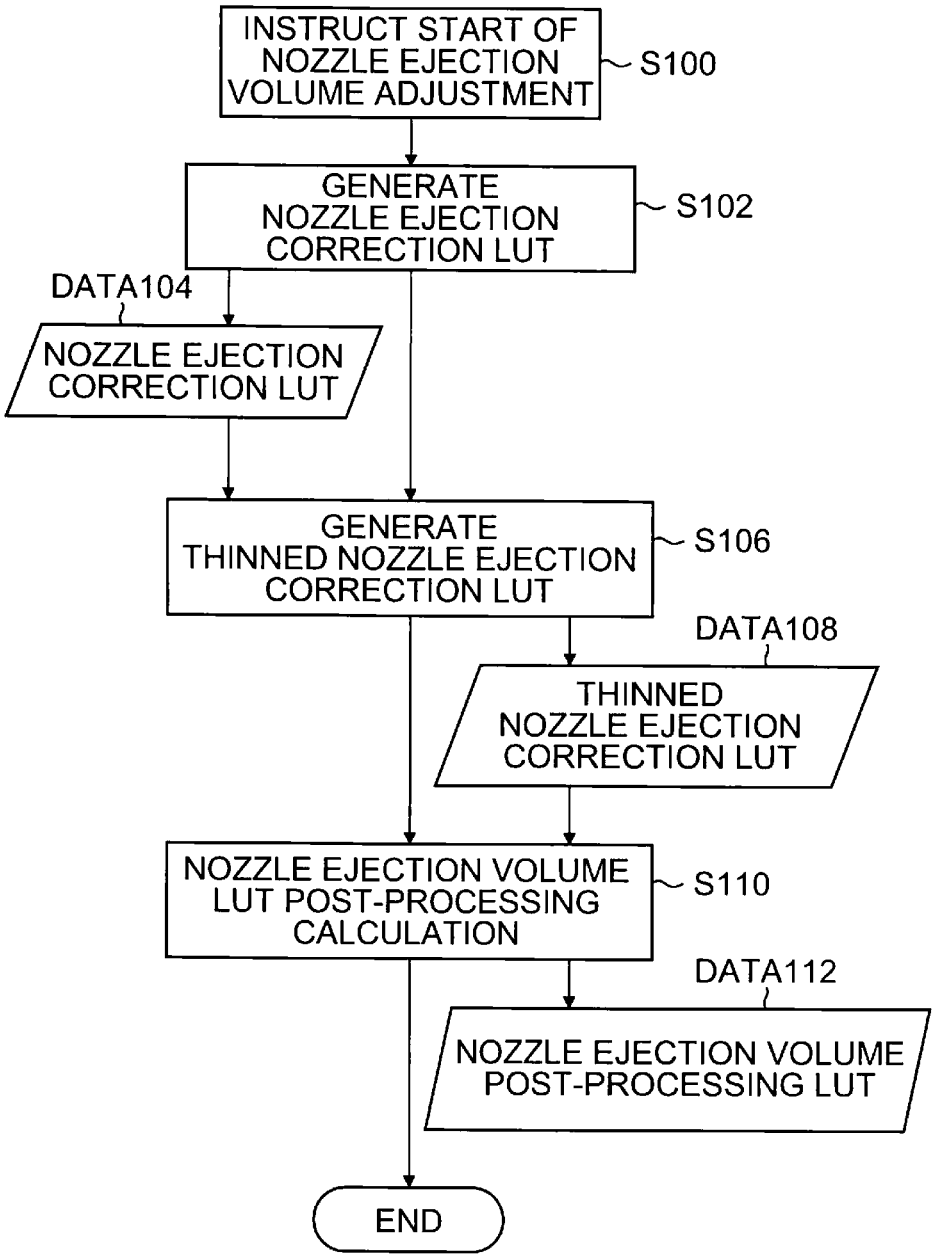
FIG. 11 is a flowchart showing a procedure for obtaining an ink ejection volume post-processing LUT.

FIG. 11 is a flowchart showing a procedure for obtaining an ink ejection volume post-processing LUT. In FIG. 11, steps which are the same as or similar to the example shown in FIG. 10 are labeled with the same step numbers and description thereof is omitted here.

As shown in FIG. 11, further nozzle ejection volume LUT post-processing calculation is carried out (step S110) on the basis of the thinned nozzle ejection correction LUT (DATA 108) generated by the thinned nozzle ejection correction LUT generation processing (step S106), thereby yielding a nozzle ejection volume post-processing LUT (DATA 112).

Desirably, the approximate upper limit of the data volume of the thinned ink ejection correction LUT, or the nozzle ejection volume post-processing LUT, is about 1 Mb. In other words, if the data volume of the nozzle ejection correction LUTs is about 100 to 200 Mb, then desirably the data volume is reduced to approximately 1/100 to 1/200 of this volume.

<Contents of Ink Ejection Volume Characteristics Evaluation Processing>

Figure 12:
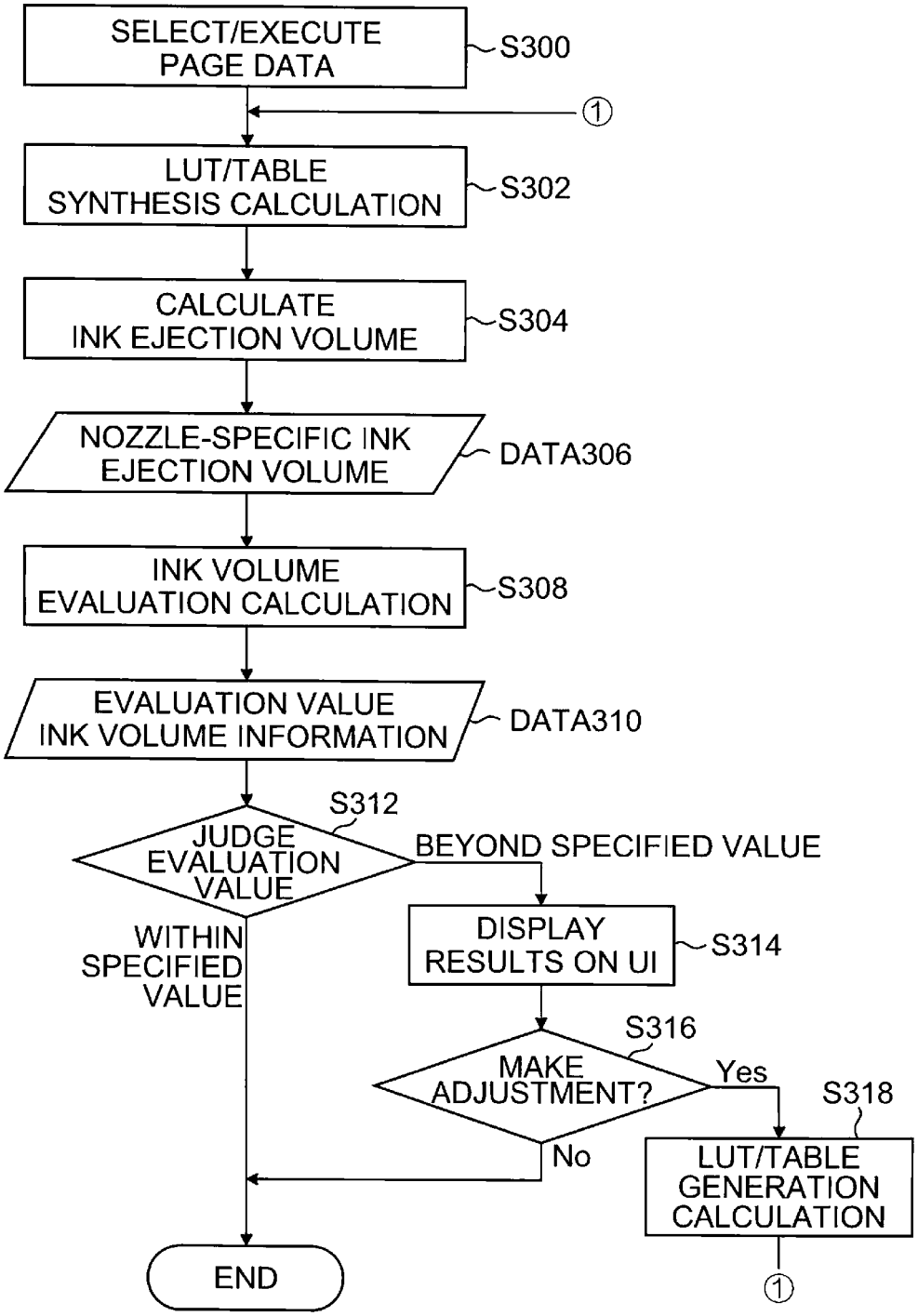
FIG. 12 is a flowchart showing a flow of ink ejection volume characteristics evaluation processing.

FIG. 12 is a flowchart showing a flow of ink ejection volume characteristics evaluation processing. This processing is started when the page data to be printed is selected and a print execution instruction is input (step S300). By this print execution instruction, the type of paper used and the halftoning conditions are specified, and it is possible to advance to LUT/table synthesis processing (step S302).

In step S302, the tone conversion LUTs and the thinned nozzle ejection correction LUT (or the nozzle ejection volume post-processing LUT) are synthesized to generate a synthesized LUT for a plurality of nozzles in the nozzle alignment direction (a portion of the nozzle row).

Thereupon, the ejection volumes of the plurality of nozzles in the nozzle alignment direction which are the object of processing are calculated from the evaluation input signal, the halftone table used, and the liquid volume per droplet for each droplet type (the designed volume value for the large, medium and small droplets, or the average volume value for each type of droplet) (step S304). For the evaluation input signal, a tone signal is selected which uses a relatively large amount of each of the C, M, Y, K inks. For example, it is possible to use a signal of a (solid) image of uniform density based on a density value (tone) in a range of 70% to 90% of the maximum recording density, in a gray color.

A signal converted from the synthesized LUT is determined from the evaluation input signal, and the average droplet ejection point characteristics (dot rate) of the large, medium and small dots, are determined in relation to this signal, from the halftone table, and are multiplied by the liquid volumes of the ink particles of each dot size (the ink droplet ejection volumes) to calculate the ink ejection volumes of the C, M, Y, K heads.

Figure 13:
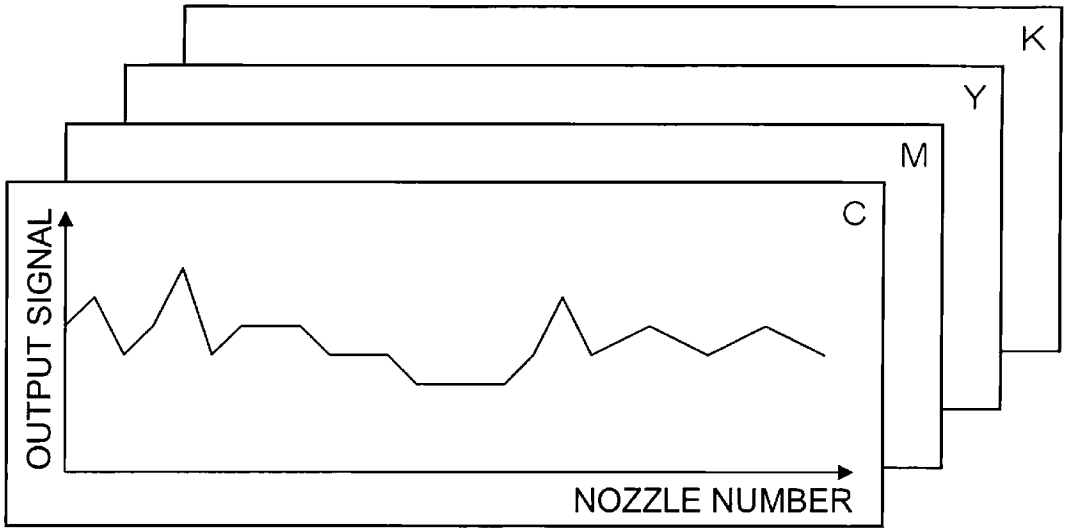
FIG. 13 is a diagram showing one example of data obtained by an ink ejection volume calculation step (S302 in FIG. 12)

FIG. 13 shows one example of data obtained by step S304. As shown in FIG. 13, data for output signals corresponding to the nozzle numbers (signal values reflecting the ink ejection volume) is obtained for each of the heads of the respective colors, CMYK.

Figure 14:
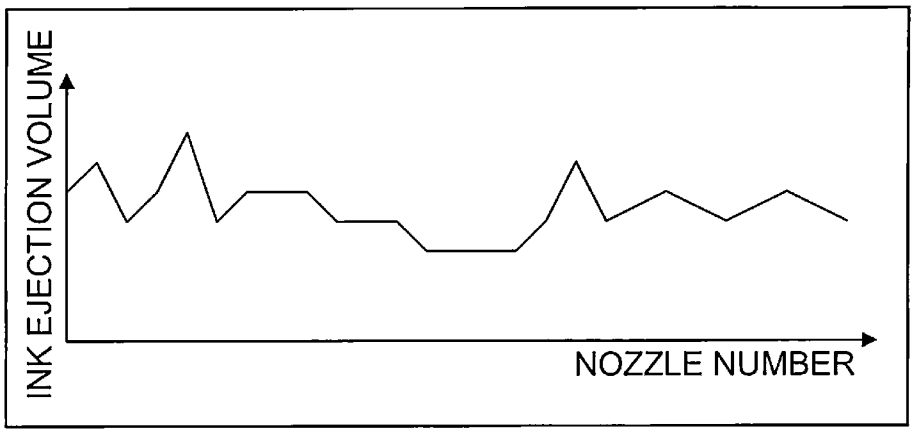
FIG. 14 is a diagram showing an example of nozzle-specific ink ejection volume data (DATA 306 in FIG. 12)

Ink ejection volume data for each nozzle position (DATA 306 in FIG. 12) is generated on the basis of this ink ejection volume data for each head. In other words, the ink ejection volume data (FIG. 12) for each head is summed, and ink ejection volume data (called the "nozzle-specific ink ejection volume") which corresponds to the pixel positions (in other words, nozzle numbers) in the nozzle row direction on the recording medium (the main scanning direction) is obtained. FIG. 14 shows one example of nozzle-specific ink ejection volume data (DATA 306). The ink ejection volume data corresponding to the nozzle numbers is obtained as shown in FIG. 14. The nozzle-specific ink ejection volume data represents a one-dimensional ink volume along the nozzle alignment direction (the ink volume when the ink dots are aligned in one row), and shows the total ink ejection volume of all of the ink colors of C, M, Y and K.

Thereupon, the procedure advances to step S308 in FIG. 12 and ink volume evaluation calculation is carried out on the basis of the nozzle-specific ink ejection volume data. In order to ascertain whether or not print quality can be guaranteed, a plurality of evaluation functions corresponding to respective aspects of print quality are prepared, and evaluation values for each evaluation function are respectively determined from the nozzle-specific ink ejection volume data (see FIG. 14).

For example, in order to guarantee quality in terms of paper deformation, it is evaluated whether or not the ink ejection volume exceeds an upper limit. The evaluation method used in this case involves calculating whether or not the integrated value of the ink volume distribution in a prescribed width in the nozzle alignment direction exceeds a specific value (threshold value). As concrete examples of the evaluation function, it is possible to adopt a moving average calculation mask in the nozzle alignment direction (nozzle row direction) (for example, a 10-pixel moving average mask), or a weighting filter, or the like.

Figure 15:
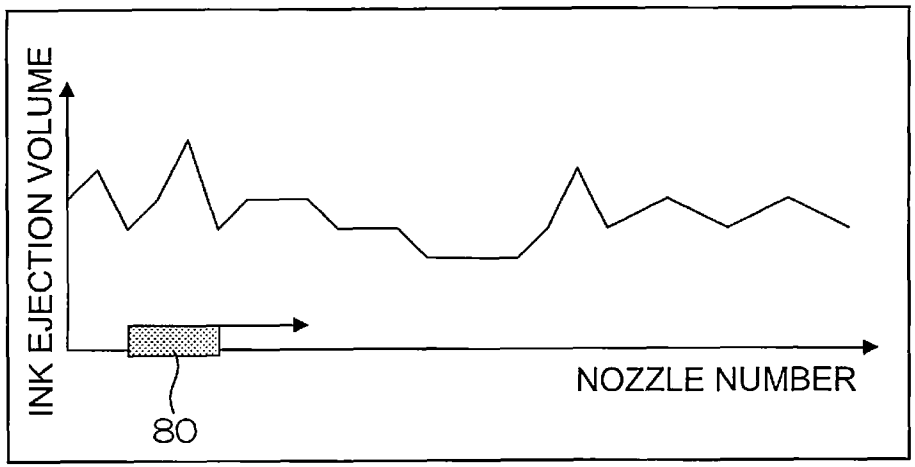
FIG. 15 is an illustrative diagram showing a conceptual view of a case where an evaluation value is calculated using a moving average mask (reference numeral 80)

FIG. 15 shows a schematic view of a case where an evaluation value is calculated by using a moving average mask (reference numeral 80), as an example of the evaluation function. The evaluation function should be a conversion formula which calculates a value that reflects the average ink volume of the pixels in a section of a certain length (a prescribed width) in the nozzle alignment direction (one dimension), as an evaluation indicator.

Figure 16:
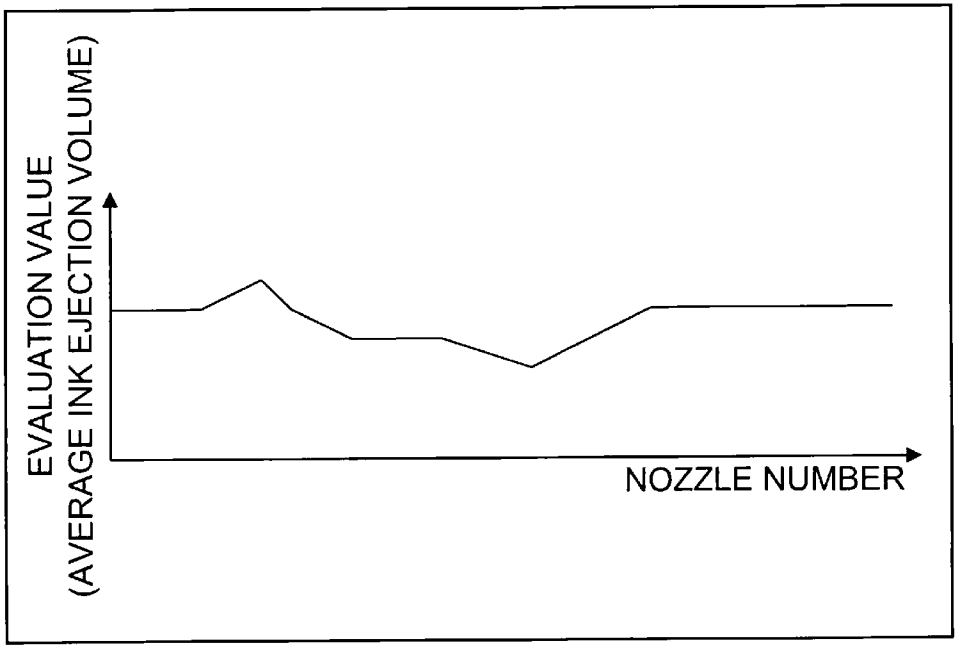
FIG. 16 is a diagram showing one example of the evaluation value calculation results.

FIG. 16 is a diagram showing one example of the evaluation value calculation results. By the calculation in step S308 in FIG. 12, evaluation values which indicate the average ink ejection volume for each nozzle position (nozzle number) are obtained as shown in FIG. 16.

Furthermore, if the calculation results for the evaluation value include a region which exceeds the prescribed specific value (threshold value) in a nozzle row, then further processing is carried out to calculate the region in question, the color hue and the amount of excess. In this way, evaluation value information and information for the portion where the ink amount (density) exceeds the specific value (threshold value) (hereinafter, called "ink volume information") is obtained.

DATA 310 in FIG. 12 indicates evaluation value information obtained at step S308 and ink volume information. Subsequently, the procedure advances to an evaluation value judgment step in step S312. In the case of the present embodiment, if the average ink volume per pixel of the dot row in a prescribed width w in the nozzle alignment direction (main scanning direction) exceeds a specific value Th, then it is judged that quality in terms of paper deformation cannot be guaranteed. Since the values of w and Th differ depending on the type of paper and the properties of the ink used, and the like, then the judgment conditions and threshold values are determined by prior experimentation, and the like.

In the judgment in step S312, processing is terminated if the evaluation value is less than the specified value. On the other hand, if the evaluation value is greater than the specified value, a display indicating that the ink volume is over the specified value is shown in the user interface (step S314) and the operator is prompted to input an instruction indicating whether to make an adjustment or to continue without making alterations. The reporting device which reports to the operator (user) that the ink volume is over the specified value is not limited to a mode which displays a warning, or the like, on the screen of a monitor 16, and may also employ a mode which emits a warning sound, an output of a voice-based warning message, switching on or switching off of a warning lamp, or a suitable combination of these.

In step S316, it is judged whether or not there is an instruction to make an adjustment. If an adjustment is to be made, then the tone conversion LUT that is to be corrected, and the position of the correction are identified, from the information about the region where the ink volume has exceeded the specific value in the nozzle alignment direction, the color hue, and the amount of excess, and correction of the LUT is carried out in a range which does not impair print quality. In conjunction with this correction operation, new LUT/table generation calculation processing is carried out (step S318). Thereupon, the procedure returns to step S302, and the processing in steps S302 to S312 is carried out again on the basis of the corrected LUT/table.

The processing in steps S302 to S318 is continued until the evaluation value comes within the specified value in the judgment in step S312. When the density has been adjusted in such a manner that the evaluation value is within the specified value, then the present processing terminates.

Due to steps S302 to S308 in the processing flow shown in FIG. 12, the ink ejection volume characteristics evaluation processing does not determine the ink volumes of each and every one of the nozzles, but rather extracts only a region having a relatively high ink volume, from the ink ejection correction LUTs, and carries out calculation for that region only, thereby further shortening the calculation time.

A program for achieving the processing contents performed by the PC 14 described in the present embodiment can be recorded on a CD-ROM, a magnetic disk, or another information storage medium (external storage apparatus), and the program can be provided to a third party by means of this information recording medium, or a download service for the program can be provided via a communications circuit, such as the Internet, or the program can be provided as a service of an ASP (Application Service Provider).

Furthermore, it is also possible to adopt a mode in which all or a portion of a program for achieving the processing contents performed by the PC 14 described in the present embodiment is incorporated into an upper-level control apparatus, such as a host computer, and is employed as an operating program for a central processing unit (CPU) in the printer 12.

<Example of Composition of Inkjet Recording Apparatus>

Next, an example of the composition of an inkjet recording apparatus which is one example of the printer 12 in FIG. 1 will be described.

Figure 17:
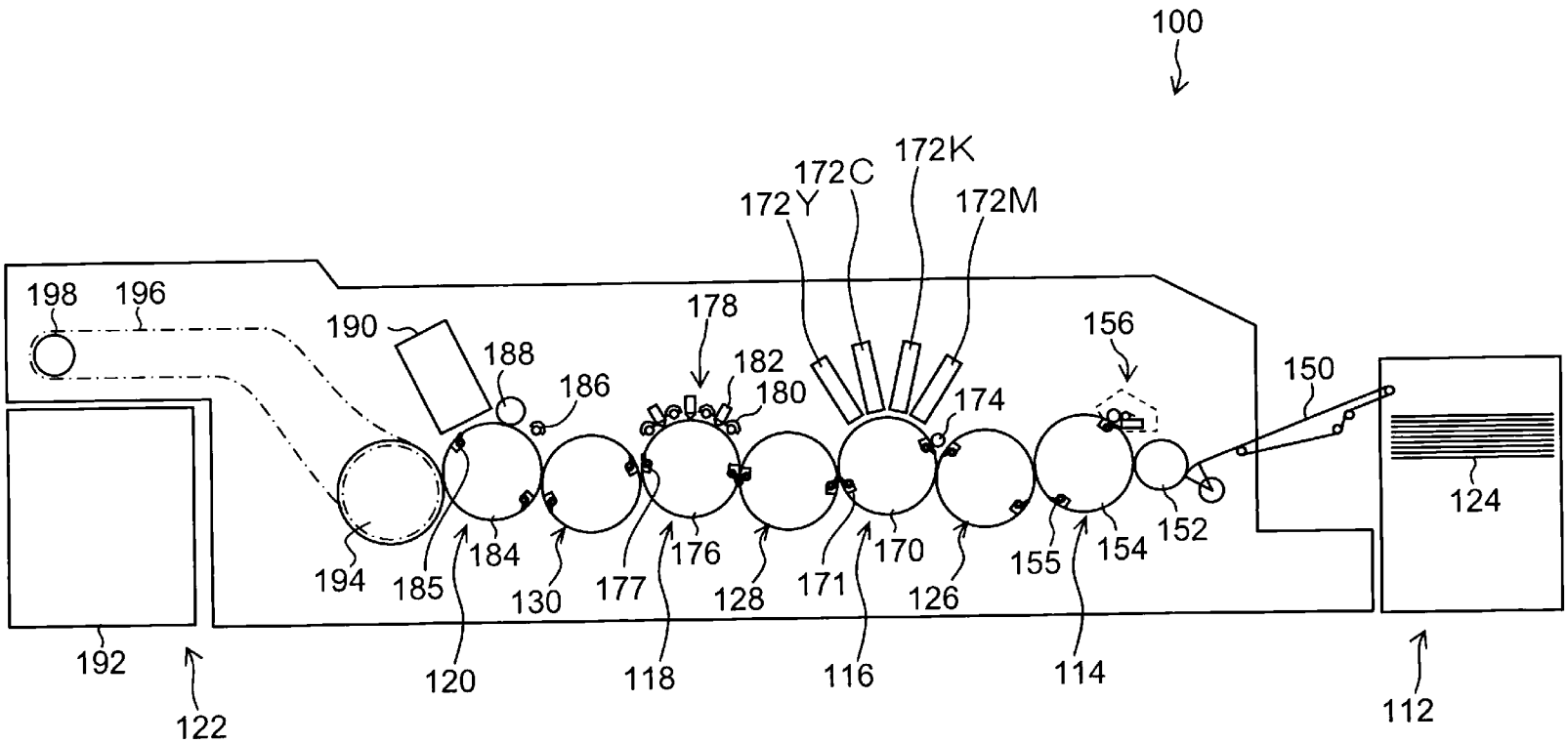
FIG. 17 is a general schematic drawing of an inkjet recording apparatus.

FIG. 17 is an example of the composition of an inkjet recording apparatus relating to an embodiment of the present invention. The inkjet recording apparatus 100 is an inkjet recording apparatus using a direct image formation method, which forms a desired color image by ejecting droplets of inks of a plurality of colors from long inkjet heads 172M, 172K, 172C and 172Y onto a recording medium 124 (called "paper" below) held on an image formation drum 170 of an image formation unit 116. The inkjet recording apparatus 100 is an image forming apparatus of a drop on-demand type employing a two-liquid reaction (aggregation) method in which an image is formed on a recording medium 124 by depositing a treatment liquid (here, an aggregating treatment liquid) on a recording medium 124 before ejecting droplets of ink, and causing the treatment liquid and ink liquid to react together.

As shown in this figure, the inkjet recording apparatus 100 principally includes a paper feed unit 112, a treatment liquid deposition unit 114, an image formation unit 116, a drying unit 118, a fixing unit 120 and a paper output unit 122.

(Paper Supply Unit)

Recording media 124 which is cut sheet paper is stacked in the paper supply unit 112. The recording media 124 is supplied to the treatment liquid deposition unit 114, one sheet at a time, from a paper supply tray 150 of the paper supply unit 112. Cut sheet paper (cut paper) is used as the recording medium 124, but it is also possible to adopt a composition in which paper is supplied from a continuous roll (rolled paper) and is cut to the required size.

(Treatment Liquid Deposition Unit)

The treatment liquid deposition unit 114 is a mechanism which deposits treatment liquid onto a recording surface of the recording medium 124. The treatment liquid includes a coloring material aggregating agent which aggregates the coloring material (in the present embodiment, the pigment) in the ink deposited by the image formation unit 116, and the separation of the ink into the coloring material and the solvent is promoted due to the treatment liquid and the ink making contact with each other.

The treatment liquid deposition unit 114 includes a paper supply drum 152, a treatment liquid drum 154 and a treatment liquid application apparatus 156. The treatment liquid drum 154 includes a hook-shaped gripping device (gripper) 155 provided on the outer circumferential surface thereof, and is devised in such a manner that the leading end of the recording medium 124 can be held by gripping the recording medium 124 between the hook of the holding device 155 and the circumferential surface of the treatment liquid drum 154. The treatment liquid drum 154 may include suction holes provided in the outer circumferential surface thereof, and be connected to a suctioning device which performs suctioning via the suction holes. By this means, it is possible to hold the recording medium 124 tightly against the circumferential surface of the treatment liquid drum 154.

The treatment liquid application apparatus 156 is disposed so as to oppose the circumferential surface of the treatment liquid drum 154. The treatment liquid application apparatus 156 includes a treatment liquid vessel in which treatment liquid is stored, an anilox roller (metering roller) which is partially immersed in the treatment liquid in the treatment liquid vessel, and a rubber roller which transfers a dosed amount of the treatment liquid to the recording medium 124, by being pressed against the anilox roller and the recording medium 124 on the treatment liquid drum 154. According to this treatment liquid application apparatus 156, it is possible to apply treatment liquid to the recording medium 124 while dosing the amount of the treatment liquid. In the present embodiment, a composition is described which uses a roller-based application method, but the method is not limited to this, and it is also possible to employ various other methods, such as a spray method, an inkjet method, or the like.

The recording medium 124 onto which treatment liquid has been deposited is transferred from the treatment liquid drum 154 to the image formation drum 170 of the image formation unit 116 via the intermediate conveyance unit 126.

(Image Formation Unit)

The image formation unit 116 includes an image formation drum 170, a paper pressing roller 174, and inkjet heads 172M, 172K, 172C and 172Y. Similarly to the treatment liquid drum 154, the image formation drum 170 includes a hook-shaped holding device (gripper) 171 on the outer circumferential surface of the drum.

The inkjet heads 172M, 172K, 172C and 172Y are each full-line type inkjet recording heads (recording heads) having a length corresponding to the maximum width of the image forming region on the recording medium 124, and a nozzle row of nozzles for ejecting ink arranged throughout the whole width of the image forming region is formed in the ink ejection surface of each head. The inkjet heads 172M, 172K, 172Y and 172Y are disposed so as to extend in a direction perpendicular to the conveyance direction of the recording medium 124 (the direction of rotation of the image formation drum 170).

When droplets of the corresponding colored ink are ejected from the inkjet heads 172M, 172K, 172C and 172Y toward the recording surface of the recording medium 124 which is held tightly on the image formation drum 170, the ink makes contact with the treatment liquid which has previously been deposited onto the recording surface by the treatment liquid deposition unit 114, the coloring material (pigment) dispersed in the ink is aggregated, and a coloring material aggregate is thereby formed. By this means, flowing of coloring material, and the like, on the recording medium 124 is prevented and an image is formed on the recording surface of the recording medium 124.

In other words, the recording medium 124 is conveyed at a constant speed by the image formation drum 170, and it is possible to record an image on an image forming region of the recording medium 124 by performing just one operation (or one sub-scanning operation) of moving the recording medium 124 and the respective inkjet heads 172M, 172K, 172C and 172Y relatively in the conveyance direction.

The recording medium 124 onto which an image has been formed in the image formation unit 116 is transferred from the image formation drum 170 to the drying drum 176 of the drying unit 118 via the intermediate conveyance unit 128.

(Drying Unit)

The drying unit 118 is a mechanism which dries the water content contained in the solvent which has been separated by the action of aggregating the coloring material includes a drying drum 176 and a solvent drying apparatus 178. Similarly to the treatment liquid drum 154, the drying drum 176 includes a hook-shaped holding device (gripper) 177 provided on the outer circumferential surface of the drum, in such a manner that the leading end of the recording medium 124 can be held by the holding device 177.

The solvent drying apparatus 178 is disposed in a position opposing the outer circumferential surface of the drying drum 176, and is constituted by a plurality of halogen heaters 180 and hot air spraying nozzles 182 disposed respectively between the halogen heaters 180. The recording medium 124 on which a drying process has been carried out in the drying unit 118 is transferred from the drying drum 176 to the fixing drum 184 of the fixing unit 120 via the intermediate conveyance unit 130.

(Fixing Unit)

The fixing unit 120 is constituted by a fixing drum 184, a halogen heater 186, a fixing roller 188 and an in-line sensor 190 (corresponding to a reading apparatus). Similarly to the treatment liquid drum 154, the fixing drum 184 includes a hook-shaped holding device (gripper) 185 provided on the outer circumferential surface of the drum, in such a manner that the leading end of the recording medium 124 can be held by the holding device 185.

By means of the rotation of the fixing drum 184, the recording surface of the recording medium 124 is subjected to preliminary heating by the halogen heater 186, a fixing process by the fixing roller 188 and inspection by the in-line sensor 190.

The fixing roller 188 is a roller member for melting self-dispersing polymer micro-particles contained in the ink and thereby causing the ink to form a film, by applying heat and pressure to the dried ink, and is composed so as to heat and pressurize the recording medium 124. More specifically, the fixing roller 188 is disposed so as to press against the fixing drum 184, in such a manner that a nip is created between the fixing roller 188 and the fixing drum 184. 188 and the fixing drum 184 and is nipped with a prescribed nip pressure, whereby a fixing process is carried out.

Furthermore, the fixing roller 188 is constituted by a heated roller which incorporates a halogen lamp, or the like, and is controlled to a prescribed temperature.

An in-line sensor 190 is a device for reading in an image formed on the recording medium 124 (including a test chart for density measurement or a test pattern for ejection failure determination, or the like) and determining the density of the image, defects in the image, and so on. A CCD line sensor, or the like, is employed for the in-line sensor 190.

According to the fixing unit 120, the latex particles in the thin image layer formed by the drying unit 118 are heated, pressurized and melted by the fixing roller 188, and hence the image layer can be fixed to the recording medium 124. Furthermore, the surface temperature of the fixing drum 184 is set to no less than 50° C. Drying is promoted by heating the recording medium 124 held on the outer circumferential surface of the fixing drum 184 from the rear surface, and therefore breaking of the image during fixing can be prevented, and furthermore, the strength of the image can be increased by the effects of the increased temperature of the image.

Instead of an ink which includes a high-boiling-point solvent and polymer micro-particles (thermoplastic resin particles), it is also possible to include a monomer which can be polymerized and cured by exposure to UV light. In this case, the inkjet recording apparatus 100 includes a UV exposure unit for exposing the ink on the recording medium 124 to UV light, instead of a heat and pressure fixing unit (fixing roller 188) based on a heat roller. In this way, if using an ink containing an active light-curable resin, such as a ultraviolet-curable resin, a device which irradiates the active light, such as a UV lamp or an ultraviolet LD (laser diode) array, is provided instead of the fixing roller 188 for heat fixing.

(Paper Output Unit)

A paper output unit 122 is provided subsequently to the fixing unit 120. The paper output unit 122 includes a output tray 192, and a transfer drum 194, a conveyance belt 196 and a tensioning roller 198 are provided between the output tray 192 and the fixing drum 184 of the fixing unit 120 so as to oppose same. The recording medium 124 is sent to the conveyance belt 196 by the transfer drum 194 and output to the output tray 192. The details of the paper conveyance mechanism created by the conveyance belt 196 are not shown, but the leading end portion of a recording medium 124 after printing is held by a gripper on a bar (not illustrated) which spans between endless conveyance belts 196, and the recording medium is conveyed about the output tray 192 due to the rotation of the conveyance belts 196.

Furthermore, although not shown in FIG. 17, the inkjet recording apparatus 100 according to the present embodiment includes, in addition to the composition described above, an ink storing and loading unit which supplies ink to the inkjet heads 172M, 172K, 172C and 172Y, and a device which supplies treatment liquid to the treatment liquid deposition unit 114, as well as including a head maintenance unit which carries out cleaning (nozzle surface wiping, purging, nozzle suctioning, and the like) of the inkjet heads 172M, 172K, 172C and 172Y, a position determination sensor which determines the position of the recording medium 124 in the paper conveyance path, a temperature sensor which determines the temperature of the respective units of the apparatus, and the like.

<Composition of Head>

Next, the structure of the head will be described. The inkjet heads 172M, 172K, 172C and 172Y have a common structure, and therefore these heads are represented by a head indicated by the reference numeral 250 below.

Figure 18A:
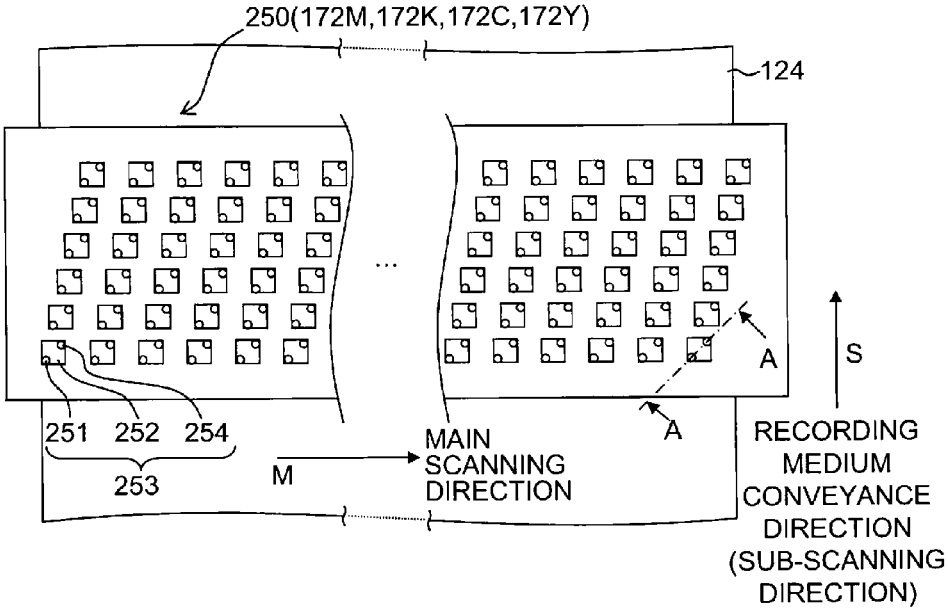
FIG. 18A is a plan view perspective diagram showing an example of the structure of a head.
Figure 18B:
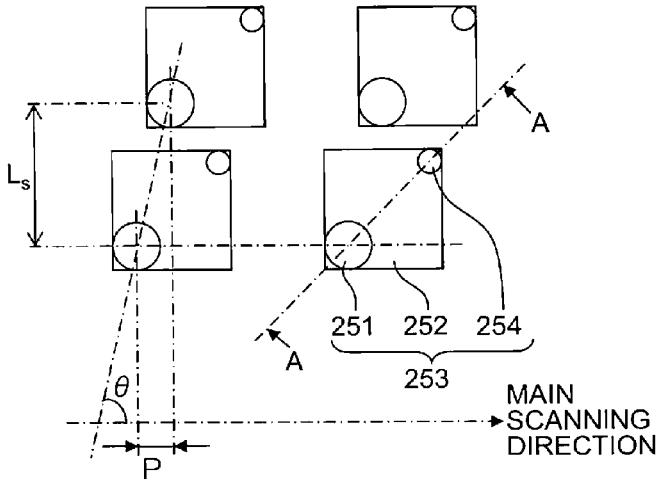
FIG. 18B is a partial enlarged view of same.

FIG. 18A is a plan view perspective diagram showing an example of the structure of a head 250, and FIG. 18B is a partial enlarged view of same. Furthermore, FIG. 19 is a cross-sectional diagram (a cross-sectional diagram along line A-A in FIG. 18) showing a three-dimensional composition of a droplet ejection element of one channel (an ink chamber unit corresponding to one nozzle 251).

As shown in FIG. 18A, the head 250 according to this example has a structure in which a plurality of ink chamber units (droplet ejection elements) 253 are arranged two-dimensionally in a matrix configuration, each ink chamber unit including a nozzle 251 forming an ink ejection port, and a pressure chamber 252 corresponding to the nozzle 251, and the like, whereby a high density is achieved in the effective nozzle pitch (projected nozzle pitch) obtained by projecting (by orthogonal reflection) the nozzles to an alignment in the lengthwise direction of the head (the direction perpendicular to the paper conveyance direction).

Figure 19A:
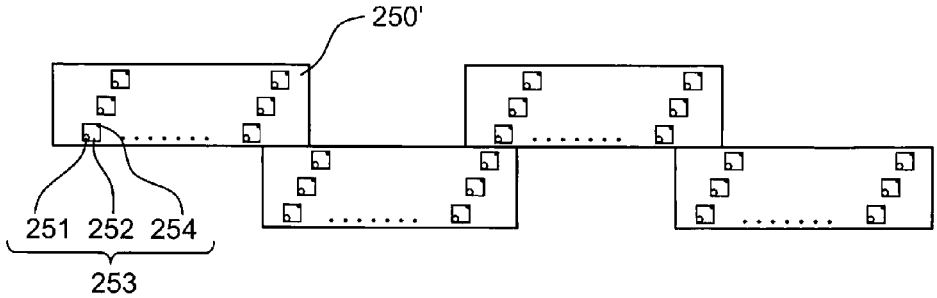
FIGS. 19A and 19B are plan view perspective diagrams showing a further example of the structure of a head.
Figure 19B:
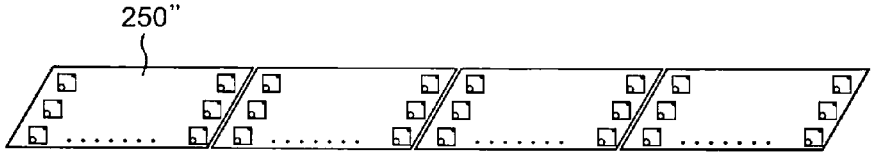

The mode of composing a nozzle row having a length equal to or greater than the full width Wm of the image formation region of the recording medium 124 in a direction (the main scanning direction, the direction indicated by arrow M) which is substantially perpendicular to the feed direction of the recording medium 124 (the sub-scanning direction, the direction of arrow S) is not limited to the present example. For example, instead of the composition in FIG. 18A, it is possible to adopt a mode in which a line head having a nozzle row of a length corresponding to the full width of the recording medium 124 is composed by joining together in a staggered configuration short head modules 250' in which a plurality of nozzles 251 are arranged in a two-dimensional arrangement, as shown in FIG. 19A, or a mode in which head modules 250" are joined together in an alignment in one row, as shown in FIG. 19B.

The pressure chambers 252 provided to correspond to the respective nozzles 251 have a substantially square planar shape (see FIGS. 18A and 18B), an outlet port to the nozzle 251 being provided in one corner of a diagonal of the pressure chamber, and an ink inlet port (supply port) 254 being provided in the other corner thereof. The shape of the pressure chambers 252 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 20:
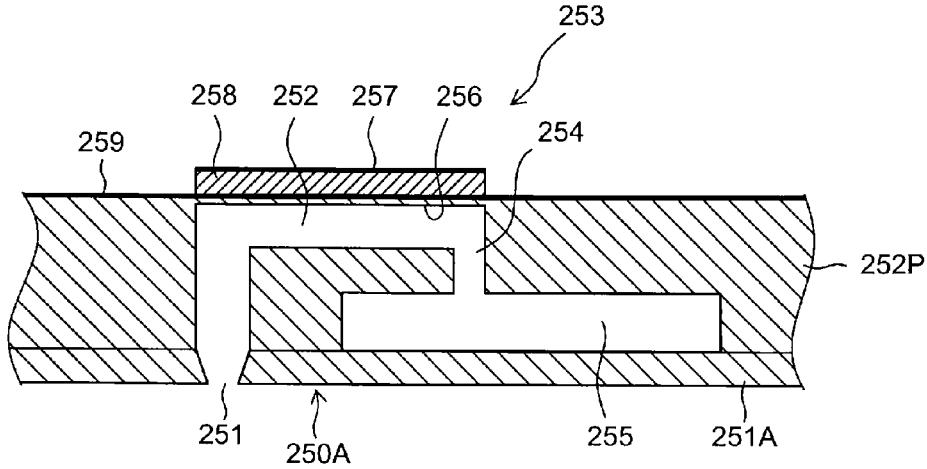
FIG. 20 is a cross-sectional diagram along line A-A in FIGS. 18A and 18B.

As shown in FIG. 20, the head 250 has a structure in which a nozzle plate 251A in which nozzles 251 are formed, a flow channel plate 252P in which flow channels such as pressure chambers 252 and a common flow channel 255, and the like, are formed, and so on, are layered and bonded together.

The flow channel plate 252P is a flow channel forming member which constitutes side wall portions of the pressure chambers 252 and in which a supply port 254 is formed to serve as a restricting section (most constricted portion) of an individual supply channel for guiding ink to each pressure chamber 252 from the common flow channel 255. For the sake of the description, a simplified view is given in FIG. 20, but the flow channel plate 252P has a structure formed by layering together one or a plurality of substrates.

The nozzle plate 251A and the flow channel plate 252P can be processed into a desired shape by a system configuration manufacturing process using silicon as a material.

The common flow channel 255 is connected to an ink tank (not shown), which is a base tank that supplies ink, and the ink supplied from the ink tank is supplied through the common flow channel 255 to the pressure chambers 252.

Piezo actuators 258 each including an individual electrode 257 are bonded to a diaphragm 256 which constitutes a portion of the surfaces of the pressure chambers 252 (the ceiling surface in FIG. 20). The diaphragm 256 according to the present embodiment is made of silicon (Si) having a nickel (Ni) conducting layer which functions as a common electrode 259 corresponding to the lower electrodes of the piezo actuators 258, and serves as a common electrode for the piezo actuators 258 which are arranged so as to correspond to the respective pressure chambers 252. A mode is also possible in which a diaphragm is made from a non-conductive material, such as resin, in which case, a common electrode layer made of a conductive material, such as metal, is formed on the surface of the diaphragm material. Furthermore, the diaphragm which also serves as a common electrode may be made of a metal (conductive material), such as stainless steel (SUS), or the like.

When a drive voltage is applied to the individual electrode 257, the piezo actuator 258 deforms, thereby changing the volume of the pressure chamber 252. This causes a pressure change which results in ink being ejected from the nozzle 251. When the piezo actuator 258 returns to its original position after ejecting ink, the pressure chamber 252 is replenished with new ink from the common flow channel 255 via the supply port 254.

The high-density nozzle head of the present embodiment is achieved by arranging a plurality of ink chamber units 253 having a structure of this kind, in a lattice configuration according to a prescribed arrangement pattern in a row direction following the main scanning direction and an oblique column direction having a prescribed non-perpendicular angle θ with respect to the main scanning direction, as shown in FIG. 18B. If the pitch between adjacent nozzles in the sub-scanning direction is taken to be $L_s$, then this matrix arrangement can be treated as equivalent to a configuration where nozzles 251 are effectively arranged in a single straight line at a uniform pitch of $P=L_s/\tan\theta$ apart in the main scanning direction.

Furthermore, in implementing the present invention, the mode of arrangement of the nozzles 251 in the head 250 is not limited to the example shown in the drawings, and it is possible to adopt various nozzle arrangements. For example, it is possible to use a single line linear nozzle arrangement, such as a V-shaped nozzle arrangement, or a zig-zag shape (W shape, or the like) in which a V-shaped nozzle arrangement is repeated.

<Action and Beneficial Effects of the Present Embodiment>

According to the present embodiment, the distribution of the ink ejection volume between the nozzles in the head is determined by calculation from information such as the tone conversion LUTs, the thinned nozzle ejection correction LUT (or the nozzle ejection volume post-processing LUT), the halftone table, and the like. Furthermore, the data (evaluation value) for judging change of the ink volume employs a value determined by an evaluation function from the nozzle ejection volume information of each nozzle, on the basis of evaluation functions for judging the effects on print quality.

By calculating on the basis of the table data, it is possible to grasp an overview of the ink ejection situation in a short time (in real time), and suitable correction can be applied. Moreover, with regard to the LUTs used in calculation, by previously creating a table which extracts the required data (the thinned nozzle ejection correction LUT or nozzle ejection volume post-processing LUT) in advance, from tables having an extremely large volume (nozzle ejection correction LUTs), it is possible to carry out calculation within a practicable calculation time.

<Correspondences Between the Terminology of the Embodiments and the Terminology of the Claims>

A combination of the PC 14, the monitor 16 and the input apparatus 18 corresponds to a "liquid ejection volume control apparatus". The tone conversion LUT corresponds to a "first LUT" and the tone conversion LUT storage unit 40 corresponds to a "first LUT storage device". The nozzle ejection correction LUT corresponds to a "second LUT" and the nozzle ejection correction LUT storage unit 42 corresponds to a "second LUT storage device". The thinned nozzle ejection correction LUT or the nozzle ejection volume post-processing LUT corresponds to a "third LUT" and the thinned nozzle ejection correction LUT storage unit 46 or the nozzle ejection volume post-processing LUT storage unit 48 corresponds to a "third LUT storage device". The ink ejection volume characteristics evaluation processing unit 36 corresponds to an "evaluation processing device". The composition which enables the density to be adjusted by correcting and changing the tone conversion LUTs via the user interface (monitor 16 and input apparatus 18) corresponds to an "adjusting device". The composition which obtains density information from the read data of the test chart for density measurement corresponds to a "density information acquiring device". The LUT/table generating unit 34 corresponds to a "second LUT generating device" and a "third LUT generating device". The composition which displays ink volume information, and the like, on the monitor 16 via the UI control unit 32 corresponds to an "information presenting device". The inkjet printing system 10 corresponds to an "inkjet apparatus".

Modification Examples

In the embodiment described above, an inkjet recording apparatus based on a method which forms an image by ejecting ink droplets directly onto the recording medium 124 (direct recording method) was described, but the application of the present invention is not limited to this, and the present invention can also be applied to an image forming apparatus of an intermediate transfer type which provisionally forms an image (primary image) on an intermediate transfer body, and then performs final image formation by transferring the image onto recording paper in a transfer unit.

<Device for Causing Relative Movement of Head and Paper>

In the embodiment described above, an example is given in which a recording medium is conveyed with respect to a stationary head, but in implementing the present invention, it is also possible to move a head with respect to a stationary recording medium (image formation receiving medium).

<Recording Medium>

"Recording medium" is a general term for a medium on which dots are recorded by droplets ejected from an inkjet head, and this includes various terms, such as print medium, recording medium, image forming medium, image receiving medium ejection receiving medium, and the like. In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, cloth, nonwoven cloth, a printed substrate on which a wiring pattern, or the like, is formed, or a rubber sheet.

<Ejection Method>

The device which generates pressure (ejection energy) for ejection in order to eject droplets from the nozzles of the inkjet head is not limited to a piezo actuator (piezoelectric element). Apart from a piezoelectric element, it is also possible to employ pressure generating elements (ejection energy generating elements) of various kinds, such as a heater (heating element) in a thermal method (a method which ejects ink by using the pressure produced by film boiling caused by heat from the heater), or various actuators based on other methods. A corresponding energy generating element is provided in the flow channel structure in accordance with the ejection method of the head.

<Apparatus Application Examples>

In the embodiment described above, application to an inkjet recording apparatus for graphic printing was described, but the scope of application of the present invention is not limited to this example. For example, the present invention can also be applied widely to inkjet systems which obtain various shapes or patterns using liquid function material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

The present invention is not limited to the embodiments described above, and various modifications can be made within the scope of the technical idea of the invention, by a person having normal knowledge of the field.

<Appendix: Disclosed Modes of the Invention>

As has become evident from the detailed description of the embodiment of the present invention given above, the present specification includes disclosure of various technical ideas including at least the inventions described below.

(Invention 1): A liquid ejection volume control apparatus, comprising: a first lookup table storage device which stores a first lookup table that specifies an input/output relationship for converting tones of an input signal; a second lookup table storage device which stores a second lookup table that specifies a signal conversion relationship for correcting variation in an ejection volume in nozzle units in a liquid ejection head having a plurality of nozzles; a halftone table storage device which stores a halftone table that specifies a relationship between a dot recording rate and a signal value in a dot arrangement obtained by halftone processing; a third lookup table generating device which generates a third lookup table which is used in calculation for evaluating a liquid ejection volume, by extracting a portion of the data from the second lookup table which is prescribed in nozzle units; a third lookup table storage device which stores the third lookup table; an evaluation processing device which performs the calculation for evaluating the liquid ejection volume, the evaluation processing device for performing calculation for evaluating a liquid ejection volume corresponding to an evaluation input signal for evaluating the liquid ejection volume produced by the liquid ejection head, on the basis of the evaluation input signal, the first lookup table, the third lookup table, the halftone table and the liquid volume per dot; and an adjusting device which adjusts the ejection volume on the basis of the evaluation results from the evaluation processing device, in such a manner that the liquid ejection volume corresponding to the evaluation input signal does not exceed a specified value.

According to invention 1, it is possible to calculate an overview of the distribution of the liquid ejection volume in a nozzle row of a liquid ejection head, quickly and readily. From the calculation results of the evaluation value, it is possible to judge whether or not to adjust the ejection volume and suitable adjustment can be carried out.

(Invention 2): The liquid ejection volume control apparatus as defined in invention 1, wherein the third lookup table generating device generates the third lookup table by extracting data at a constant nozzle spacing in an alignment sequence of the plurality of nozzles, from the second lookup table.

The "alignment sequence of the plurality of nozzles" means the nozzle alignment sequence in an effective nozzle row in a nozzle arrangement where the nozzles are arranged so as to be able to record droplet ejection points (recording positions) on the recording medium at the recording resolution.

(Invention 3): The liquid ejection volume control apparatus as defined in invention 1 or 2, wherein the third lookup table generating device generates the third lookup table by extracting data for nozzles in a region where the ejection volume is relatively large, from the second lookup table.

It is possible to identify nozzles having a relatively large ejection volume from the shape of the curve of the second lookup table which is specified in nozzle units. (Invention 4): The liquid ejection volume control apparatus as defined in any one of inventions 1 to 3, wherein the third lookup table generating device generates the third lookup table by extracting data for nozzles at which the ejection volume exceeds a reference value, from the second lookup table.

It is possible to identify nozzles having an ejection volume exceeding a reference value, from the shape of the curve of the second lookup table which is specified in nozzle units.

(Invention 5): The liquid ejection volume control apparatus as defined in any one of inventions 1 to 4, wherein the third lookup table is constituted by unevenly spaced data in which only data required for calculation by the evaluation processing device is extracted.

It is possible to make the nozzle spacing of the extracted nozzles uneven. Furthermore, the input values in the lookup table for one nozzle can have uneven spacing. Desirably, data of a portion where the ejection volume is relatively large is extracted preferentially.

(Invention 6): The liquid ejection volume control apparatus as defined in any one of inventions 1 to 5, wherein the third lookup table is a thinned nozzle ejection correction lookup table obtained by extracting a portion of data from the second lookup table which is determined in nozzle units.

(Invention 7): The liquid ejection volume control apparatus as defined in any one of inventions 1 to 5, wherein the third lookup table is in the form of intermediate data in which a number of lookup tables is reduced by processing to synthesize ejection volume information related to nozzles in a prescribed range and to gather the information into one type of lookup table, from a thinned nozzle ejection correction lookup table which is obtained by extracting a portion of data from the second lookup table which is determined in nozzle units.

According to this mode, it is possible to create data whose data volume is smaller than the nozzle ejection correction lookup table, and further shortening of the calculation time can be achieved.

(Invention 8): The liquid ejection volume control apparatus as defined in any one of inventions 1 to 5, wherein the third lookup table is a nozzle ejection volume post-processing lookup table in which data volume is made smaller than that of the thinned nozzle ejection correction lookup table, by further advancing processing required for the calculation for evaluating the liquid ejection volume on the basis of the thinned nozzle ejection correction lookup table which is obtained by extracting a portion of data from the second lookup table which is determined in nozzle units.

(Invention 9): The liquid ejection volume control apparatus as defined in any one of inventions 1 to 8, further comprising a density information acquiring device which acquires output density data indicating recording density characteristics for each nozzle in the liquid ejection head; and a second lookup table generating device which generates the second lookup table by calculating a density correction value for each nozzle from the output density data.

(Invention 10): The liquid ejection volume control apparatus as defined in any one of inventions 1 to 9, wherein the third lookup table is created beforehand from the second lookup table at a timing separate from that for the processing by the evaluation processing device, and the third LUT is stored in the third lookup table storage unit.

By this means, it is possible to shorten the calculation time yet further.

(Invention 11): The liquid ejection volume control apparatus as defined in invention 10, wherein the third lookup table is also generated at the same time as generating the second lookup table.

(Invention 12): The liquid ejection volume control apparatus as defined in any one of inventions 1 to 11, further comprising an information presenting device which reports evaluation results of the evaluation processing device.

By displaying the evaluation results, it is possible to prompt the operator to adjust the density.

(Invention 13): The liquid ejection volume control apparatus as defined in any one of inventions 1 to 12, wherein the adjusting device is a first lookup table adjusting device which changes the first lookup table.

By correcting and changing the tone conversion lookup table, it is possible to reduce the output density of the whole head, and the ink volume can be restricted.

(Invention 14): The liquid ejection volume control apparatus as defined in any one of inventions 1 to 13, wherein the evaluation processing device calculates an evaluation value which represents a liquid volume per pixel of a pixel row in a prescribed width.

(Invention 15): The liquid ejection volume control apparatus as defined in any one of inventions 1 to 14, wherein in the calculation for evaluating the liquid ejection volume, a moving average mask or a weighted filter is used as an evaluation function.

(Invention 16): A liquid ejection volume control method, comprising: a first lookup table storage step of storing a first lookup table that specifies an input/output relationship for converting tones of an input signal, in a first lookup table storage device; a second lookup table storage step of storing a second lookup table that specifies a signal conversion relationship for correcting variation in an ejection volume in nozzle units in a liquid ejection head, in a second lookup table storage device; a halftone table storage step of storing a halftone table that specifies a relationship between a dot recording rate and a signal value in a dot arrangement obtained by halftone processing, in a halftone table storage device; a third lookup table generating step of generating a third lookup table which is used in calculation for evaluating a liquid ejection volume, by extracting a portion of the data from the second lookup table which is prescribed in nozzle units; a third lookup table storage step of storing the generated third lookup table in a third lookup table storage device; an evaluation processing step of performing the calculation for evaluating the liquid volume, the evaluation processing step of performing calculation for evaluating a liquid ejection volume corresponding to an evaluation input signal for evaluating the liquid ejection volume produced by the liquid ejection head, on the basis of the evaluation input signal, the first lookup table, the third lookup table, the halftone table and the liquid volume per dot; and an adjusting step of adjusting the ejection volume on the basis of the evaluation results in the evaluation processing step, in such a manner that the liquid ejection volume corresponding to the evaluation input signal does not exceed a specified value.

The method invention of invention 16 can also combine the characteristic features of inventions 2 to 15. In this case, the second lookup table generating device is replaced by a second lookup table generating step, the information presenting device is replaced by an information presenting step, and the first lookup table adjustment device is replaced by a first lookup table adjusting step.

(Invention 17): A program for causing a computer to function as: a first lookup table storage device which stores a first lookup table that specifies an input/output relationship for converting tones of an input signal; a second lookup table storage device which stores a second lookup table that specifies a signal conversion relationship for correcting variation in an ejection volume in nozzle units in a liquid ejection head; a halftone table storage device which stores a halftone table that specifies a relationship between a dot recording rate and a signal value in a dot arrangement obtained by halftone processing; a third lookup table generating device which generates a third lookup table which is used in calculation for evaluating a liquid ejection volume, by extracting a portion of the data from the second lookup table which is prescribed in nozzle units; a third lookup table storage device which stores the third lookup table; an evaluation processing device which performs the calculation for evaluating the liquid ejection volume, the evaluation processing device for performing calculation for evaluating a liquid ejection volume corresponding to an evaluation input signal for evaluating the liquid ejection volume produced by the liquid ejection head, on the basis of the evaluation input signal, the first lookup table, the third lookup table, the halftone table and the liquid volume per dot; and an information presenting device which presents information about the evaluation results from the evaluation processing device.

The characteristic features of inventions 2 to 15 may be incorporated into the program invention of invention 17. A recording medium in which computer readable code of the program according to the above inventions of the program is stored is also included in the present invention. Such recording medium may be various types of magneto optical recording medium and semiconductor recording medium.

(Invention 18): An inkjet apparatus comprising: a liquid ejection head having a plurality of nozzles; a medium conveyance device which causes a recording medium to move relatively with respect to the liquid ejection head; an image processing device which generates binary or multiple-value data by implementing signal processing to input image data, on the basis of the first lookup table, the second lookup table and the halftone table; an ejection control device which controls ejection from the nozzles of the liquid ejection head on the basis of data generated by the image processing device; and the liquid ejection volume control apparatus as defined in any one of inventions 1 to 15.

(Invention 19): The inkjet apparatus as defined in invention 18, wherein the liquid ejection head is a head based on a single-pass method which records an image by one relatively movement of the liquid ejection head with respect to the recording medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection volume control apparatus, comprising:

a first lookup table storage device which stores a first lookup table that specifies an input/output relationship for converting tones of an input signal, wherein the first lookup table includes tone conversion lookup tables which are provided respectively for each of color signals corresponding to a plurality of ink colors, and each of the tone conversion lookup tables specifies an input/output relationship for converting an input signal value of the each of the color signals to an output signal value of the each of the color signals;

a second lookup table storage device which stores a second lookup table that specifies a signal conversion relationship for correcting variation in an ejection volume in nozzle units in a liquid ejection head having a plurality of nozzles;

a halftone table storage device which stores a halftone table that specifies a relationship between a dot recording rate and a signal value in a dot arrangement obtained by halftone processing;

a third lookup table generating device which generates a third lookup table which is used in calculation for evaluating a liquid ejection volume, by extracting a portion of the data from the second lookup table which is prescribed in nozzle units;

a third lookup table storage device which stores the third lookup table;

an evaluation processing device which performs the calculation for evaluating the liquid ejection volume, the evaluation processing device for performing calculation for evaluating a liquid ejection volume corresponding to an evaluation input signal for evaluating the liquid ejection volume produced by the liquid ejection head, on the basis of the evaluation input signal, the first lookup table, the third lookup table, the halftone table and the liquid volume per dot; and an adjusting device which adjusts the ejection volume on the basis of the evaluation results from the evaluation processing device, in such a manner that the liquid ejection volume corresponding to the evaluation input signal does not exceed a specified value.

2. The liquid ejection volume control apparatus as defined in claim 1, wherein the third lookup table generating device generates the third lookup table by extracting data at a constant nozzle spacing in an alignment sequence of the plurality of nozzles, from the second lookup table.

3. The liquid ejection volume control apparatus as defined in claim 1, wherein the third lookup table generating device generates the third lookup table by extracting data for nozzles in a region where the ejection volume is relatively large, from the second lookup table.

4. The liquid ejection volume control apparatus as defined in claim 1, wherein the third lookup table generating device generates the third lookup table by extracting data for nozzles at which the ejection volume exceeds a reference value, from the second lookup table.

5. The liquid ejection volume control apparatus as defined in claim 1, wherein the third lookup table is constituted by unevenly spaced data in which only data required for calculation by the evaluation processing device is extracted.

6. The liquid ejection volume control apparatus as defined in claim 1, wherein the third lookup table is a thinned nozzle ejection correction lookup table obtained by extracting a portion of data from the second lookup table which is determined in nozzle units.

7. The liquid ejection volume control apparatus as defined in claim 1, wherein the third lookup table is in the form of intermediate data in which a number of lookup tables is reduced by processing to synthesize ejection volume information related to nozzles in a prescribed range and to gather the information into one type of lookup table, from a thinned nozzle ejection correction lookup table which is obtained by extracting a portion of data from the second lookup table which is determined in nozzle units.

8. The liquid ejection volume control apparatus as defined in claim 1, wherein the third lookup table is a nozzle ejection volume post-processing lookup table in which data volume is made smaller than that of the thinned nozzle ejection correction lookup table, by further advancing processing required for the calculation for evaluating the liquid ejection volume on the basis of the thinned nozzle ejection correction lookup table which is obtained by extracting a portion of data from the second lookup table which is determined in nozzle units.

9. The liquid ejection volume control apparatus as defined in claim 1, further comprising:

a density information acquiring device which acquires output density data indicating recording density characteristics for each nozzle in the liquid ejection head; and a second lookup table generating device which generates the second lookup table by calculating a density correction value for each nozzle from the output density data.

10. The liquid ejection volume control apparatus as defined in claim 1, wherein the third lookup table is created beforehand from the second lookup table at a timing separate from that for the processing by the evaluation processing device, and the third lookup table is stored in the third lookup table storage unit.

11. The liquid ejection volume control apparatus as defined in claim 10, wherein the third lookup table is also generated at the same time as generating the second lookup table.

12. The liquid ejection volume control apparatus as defined in claim 1, further comprising an information presenting device which reports evaluation results of the evaluation processing device.

13. The liquid ejection volume control apparatus as defined in claim 1, wherein the adjusting device is a first lookup table adjusting device which changes the first lookup table.

14. The liquid ejection volume control apparatus as defined in claim 1, wherein the evaluation processing device calculates an evaluation value which represents a liquid volume per pixel of a pixel row in a prescribed width.

15. The liquid ejection volume control apparatus as defined in claim 1, wherein in the calculation for evaluating the liquid ejection volume, a moving average mask or a weighted filter is used as an evaluation function.

16. A liquid ejection volume control method, comprising:

a first lookup table storage step of storing a first lookup table that specifies an input/output relationship for converting tones of an input signal, in a first lookup table storage device, wherein the first lookup table includes tone conversion lookup tables which are provided respectively for each of color signals corresponding to a plurality of ink colors, and each of the tone conversion lookup tables specifies an input/output relationship for converting an input signal value of the each of the color signals to an output signal value of the each of the color signals;

a second lookup table storage step of storing a second lookup table that specifies a signal conversion relationship for correcting variation in an ejection volume in nozzle units in a liquid ejection head, in a second lookup table storage device;

a halftone table storage step of storing a halftone table that specifies a relationship between a dot recording rate and a signal value in a dot arrangement obtained by halftone processing, in a halftone table storage device;

a third lookup table generating step of generating a third lookup table which is used in calculation for evaluating a liquid ejection volume, by extracting a portion of the data from the second lookup table which is prescribed in nozzle units;

a third lookup table storage step of storing the generated third lookup table in a third lookup table storage device;

an evaluation processing step of performing the calculation for evaluating the liquid ejection volume, the evaluation processing step of performing calculation for evaluating a liquid ejection volume corresponding to an evaluation input signal for evaluating the liquid ejection volume produced by the liquid ejection head, on the basis of the evaluation input signal, the first lookup table, the third lookup table, the halftone table and the liquid volume per dot; and an adjusting step of adjusting the ejection volume on the basis of the evaluation results in the evaluation processing step, in such a manner that the liquid ejection volume corresponding to the evaluation input signal does not exceed a specified value.

17. A program for causing a computer to function as:

a first lookup table storage device which stores a first lookup table that specifies an input/output relationship for converting tones of an input signal, wherein the first lookup table includes tone conversion lookup tables which are provided respectively for each of color signals corresponding to a plurality of ink colors, and each of the tone conversion lookup tables specifies an input/output relationship for converting an input signal value of the each of the color signals to an output signal value of the each of the color signals;

a second lookup table storage device which stores a second lookup table that specifies a signal conversion relationship for correcting variation in an ejection volume in nozzle units in a liquid ejection head;

a halftone table storage device which stores a halftone table that specifies a relationship between a dot recording rate and a signal value in a dot arrangement obtained by halftone processing;

a third lookup table generating device which generates a third lookup table which is used in calculation for evaluating a liquid ejection volume, by extracting a portion of the data from the second lookup table which is prescribed in nozzle units;

a third lookup table storage device which stores the third lookup table;

an evaluation processing device which performs the calculation for evaluating the liquid ejection volume, the evaluation processing device for performing calculation for evaluating a liquid ejection volume corresponding to an evaluation input signal for evaluating the liquid ejection volume produced by the liquid ejection head, on the basis of the evaluation input signal, the first lookup table, the third lookup table, the halftone table and the liquid volume per dot; and an information presenting device which presents information about the evaluation results from the evaluation processing device.

18. An inkjet apparatus comprising:

a liquid ejection head having a plurality of nozzles;

a medium conveyance device which causes a recording medium to move relatively with respect to the liquid ejection head;

an image processing device which generates binary or multiple-value data by implementing signal processing to input image data, on the basis of the first lookup table, the second lookup table and the halftone table;

an ejection control device which controls ejection from the nozzles of the liquid ejection head on the basis of data generated by the image processing device; and the liquid ejection volume control apparatus as defined in claim 1.

19. The inkjet apparatus as defined in claim 18, wherein the liquid ejection head is a head based on a single-pass method which records an image by one relatively movement of the liquid ejection head with respect to the recording medium.

* * * * *